US005116721A

United States Patent [19]

Yamamoto

[11] Patent Number: 5,116,721

[45] Date of Patent: May 26, 1992

[54] METHOD OF FORMING A COLOR IMAGE BY HIGH-SPEED DEVELOPMENT PROCESSING

[75] Inventor: Soichiro Yamamoto, Kanagawa, Japan

[73] Assignee: Fuji Photo Film Co., Ltd., Kanagawa, Japan

[21] Appl. No.: 578,974

[22] Filed: Sep. 7, 1990

[30] Foreign Application Priority Data

Sep. 7, 1989 [JP] Japan ..... 1-232590

[51] Int. Cl.[5] ..... G03C 7/30; G03D 3/04

[52] U.S. Cl. ..... 430/351; 430/383; 430/403; 430/505; 430/545; 430/546; 430/963; 354/325; 354/328

[58] Field of Search ..... 430/434, 464, 467, 553, 430/552, 557, 558, 546, 567, 383, 351, 963, 403, 505, 545; 354/325, 328

[56] References Cited

U.S. PATENT DOCUMENTS

| | | | |
|---|---|---|---|
| 4,745,047 | 5/1988 | Asami et al. | 430/380 |
| 4,803,152 | 2/1989 | Momoki et al. | 430/567 |
| 4,818,673 | 4/1989 | Ueda et al. | 430/566 |
| 4,837,140 | 6/1989 | Ikeda et al. | 430/430 |
| 4,868,098 | 9/1989 | Steiger et al. | 430/963 |
| 4,894,319 | 1/1990 | Ikeda et al. | 430/383 |
| 4,925,778 | 5/1990 | Wernicke | 430/383 |
| 5,023,644 | 6/1991 | Kurematsu et al. | 354/328 |
| 5,063,139 | 11/1991 | Hayashi | 430/505 |

FOREIGN PATENT DOCUMENTS

| | | | |
|---|---|---|---|
| 0273044 | 10/1989 | Japan | 354/325 |
| 0279247 | 11/1989 | Japan | 354/325 |
| 139552 | 5/1990 | Japan | 430/963 |

OTHER PUBLICATIONS

Crabtree, J. I., "Rapid Processing of Films and Papers", PSA Journal, vol. 15, Feb. 1949, pp. 130–136.

Burkin, A. R., "Ultra-Rapid Processing of Photographic Materials", The Photographic Journal, vol. 87B, 1947, pp. 108–111.

Derwent Abstracts of J62-183460, Fuji Photo, Aug. 11, 1987.

*Primary Examiner*—Richard L. Schilling

*Attorney, Agent, or Firm*—Sughrue, Mion, Zinn Macpeak & Seas

[57] ABSTRACT

A method of forming a color image comprising subjecting an imagewise exposed color photoraphic material to color development at a temperature of from 30° C. to 50° C. and for a period of from 5 seconds to 20 seconds by immersing the photographic material into a color developing solution wherein the solution contacts the surface of the photosensitive layer of the photographic material as a jet stream; wherein said color photographic material comprises a support having thereon at least two silver halide photographic emulsion layers, each of said layers comprising an emulsified dispersion of fine oleophilic grains containing at least one non-diffusive oil-soluble coupler capable of forming a dye by coupling with the oxidation product of an aromatic primary amine color developing agent and at least one high boiling point organic solvent, wherein silver halide grains in all of silver halide photographic emulsion layers on the support comprise at least 95 mol % silver chloride, and the ratio of the silver halide mean grain size calculated for each photographic emulsion layer on the support to that calculated for any other photographic emulsion layer is from 0.77/1 to 1.3/1, and wherein the color photographic material has an alkali-swelled film pH value of at least 9.0.

15 Claims, 1 Drawing Sheet

METHOD OF FORMING A COLOR IMAGE BY HIGH-SPEED DEVELOPMENT PROCESSING

FIELD OF THE INVENTION

The present invention relates to a method of forming a color image on a silver halide color photographic material. More particularly, the present invention relates to a method of forming a stable color image on the material with an excellent tone reproducibility by color development at an extremely short period of time.

BACKGROUND OF THE INVENTION

A method of forming a color image by developing exposed silver halide grains with an aromatic primary amine developing agent of followed by coupling the oxidation product of the developing agent formed by the development and a color coupler, is a technique which has heretofore been well known. Such a method is widely utilized as a so-called silver salt photographic method.

One constant important consideration in the photographic field is to effect development of photographic materials as rapid as possible in view of the necessity of improving the producibility in the laboratory and of shortening the customers' waiting time.

The easiest way of accelerating development of photographic materials is to elevate the processing temperature so as to activate the processing reaction. In such a way, noticeable shortening of the time required for the step of development has already been achieved.

Many patent publications illustrate rapid development of silver halide grains having a high silver chloride content (for example, JP-A-58-95345 (corresponding to U.S. Pat. No. 4,565,774), JP-A-59-232342, JP-A-60-19140; the term "JP-A" as used herein means an "unexamined published Japanese patent application"). In accordance with such illustrated techniques, the time for color development, which was generally 3 minutes or more, could be shortened to one minute or less by the use of such high silver chloride content silver halide grains. However, it has been found that when the processing time is further shortened to 20 seconds or less, the photographic properties are generally unstable and, in particular, the tone-reproducibility of the processed materials is unstable.

Other means of effecting high-speed development include a technique of using a color development accelerator (for example, JP-A-53-15831, JP-A-55-62450, JP-A-55-62451, JP-A-55-62452, JP-A-55-52453, JP-B-51-12422, JP-B-55-49728; the term "JP-B" as used herein means an "examined Japanese patent publication") and a technique of using a so-called auxiliary developing agent such as 3-pyrazolidones (for example, JP-A-60-26338, JP-A-60-158444, JP-A-60-158446). However, photographic materials processed by the use of such additives are known to have a drawback in that the storage stability of the processed materials is insufficient.

On the other hand, to achieve the desired effect some patent publications define the ratio of the mean grain size between plural types of silver halide grains constituting photographic materials (for example, JP-A-61-38944, JP-A-62-6247, JP-A-62-3248, JP-A-62-40456, JP-A-62-62358, JP-A-62-172348 (corresponding to U.S. Pat. No. 4,745,047), JP-A-62-253148, JP-A-63-71839 (corresponding to U.S. Pat. No. 4,803,152), JP-A-63-71838, European Patents 0248442-A2, 0230997-A2, U.S. Pat. No. 4,745,047). However, all of the photographic materials illustrated in these publications could display the effect only when they are processed for a relatively long period of time. The present inventors found, however, that the silver halide grains in the photographic materials illustrated above could be sufficiently developed for such a long period of time, but suffered from an almost complete dissolution of the grains. Therefore, one characteristic aspect of the present invention is to prevent the over-dissolution of the grains, and/or to control the dissolution in a desired range so as to impart favorable properties to the processed photographic materials.

As opposed to the above-illustrated previous techniques, high-speed development, the goal of the present invention (i.e., to complete development of photographic materials in an extremely short period of time), causes a problem in that so-called tone-reproducibility varies and good images could not be stably formed. The point to be noted in this respect is that the developability of silver halide grains in the extreme initial stage of development is poor.

In a high-speed development similar in objectives to the present invention described hereinafter, the developing agent and alkali agent, which are the main components in the developer, could barely reach the deepest portions of the photographic light-sensitive layers of the material to elevate the pH value of the material to at least the required level. To do so, the developer components had to overcome the acid components present in the deep portions of the photographic light-sensitive layers. Thus, it is necessary that the exposed photographic material is developed without delay. Accordingly, it is necessary that use of such a substance that would adsorb to silver halide grains, thus retarding the development reaction, is avoided as much as possible in such high-speed development. From this viewpoint, the known method of controlling the amount of the development-inhibiting compound so as to ensure the stability of the photographic properties of photographic materials to be processed, is not suitable to high-speed development to be effected in a short period of time, since the presence of such compounds would retard the development as a whole.

On the other hand, another desired feature of high-speed development to be effected in a short period of time is that the development when initiated as mentioned above should be completed as quickly as possible. In general, the individual silver halide grains in a photographic emulsion each have a slightly different sensitivity even though the grains as a whole may have an extremely narrow grain size distribution. Additionally, the exposure amount is not always the same in all the individual grains. Therefore, the development-initiating time and the development-finishing time during the development procedure would generally vary amongst the individual silver halide grains. Accordingly, it is necessary to eliminate the factors which would cause retardation of initiation of development of silver halide grains or would cause retardation of the completion of development thereof, as much as possible, in order that the development is effected to a practically necessary degree within a predetermined development time. From this viewpoint, the method of elevating the ratio of silver bromide to silver chloride in a portion of or in all of the silver halide grains in the photographic emulsion layer thereby to control the development speed of the silver halide grains to ensure the stability of the photographic properties, is not adequate, since development could not be finished within a pre-determined period of time. Therefore, a method of stably forming a color image without retarding development is. strongly desired which avoids the drawbacks mentioned above.

SUMMARY OF THE INVENTION

One object of the present invention is to provide a method of stably forming a color image by color development effected in an extremely short period of time.

Another object of the present invention is to provide a method of stably forming a color image having stabilized photographic properties, especially having stabilized tone-reproducibility.

The above-mentioned and other objects and advantages in accordance with the present invention are attained by a method of forming a color image comprising subjecting an imagewise exposed color photoraphic material to color development at a temperature of from 30° C. to 50° C. and for a period of from 5 seconds to 20 seconds by immersing the photographic material into a color developing solution wherein the solution contacts the surface of the photosensitive layer of the photographic material as a jet stream; wherein said color photographic material comprises a support having thereon at least two silver halide photographic emulsion layers, each of said layers comprising an emulsified dispersion of fine oleophilic grains containing at least one non-diffusive oil-soluble coupler capable of forming a dye by coupling with the oxidation product of an aromatic primary amine color developing agent and at least one high boiling point organic solvent, wherein silver halide grains in all of silver halide photographic emulsion layers on the support comprise at least 95 mol % silver chloride, and the ratio of the silver halide mean grain size calculated for each photographic emulsion layer on the support to that calculated for any other photographic emulsion layer is from 0.77/1 to 1.3/1, and wherein the color photographic material has an alkali-swelled film pH value of at least 9.0.

As one preferred embodiment, the temperature for the color development is within the range of from 35° C. to 50° C. and the time therefor is within the range of from 5 seconds to 15 seconds.

DETAILED DESCRIPTION OF THE INVENTION

Figure 1:
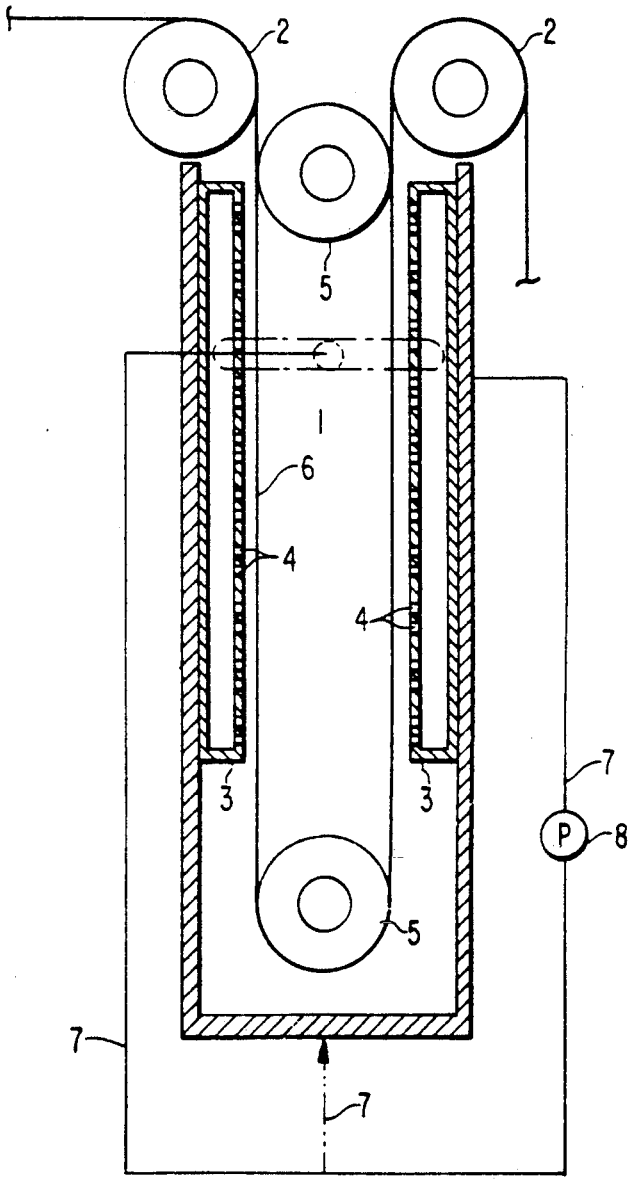
FIG. 1 is a cross sectional view of an apparatus for color development which has means for forming jet streams.

The development time in the present invention is that from immersing the photographic material to immersing the photographic material into the subsequent processing solution after passing through air.

The alkali-swelled film pH value characterizing the photographic material to be processed by the method of the present invention may be measured by the method described below.

18.7 g of potassium carbonate and 3.9 g of sodium hydrogencarbonate were dissolved into water and the resulting solution was adjusted to pH of 10.05 by the use of 0.1N potassium hydroxide solution. This is Aqueous Solution (A). This was then diluted to 1/10 to prepare Aqueous Solution (B). Next, 20 microliters of Aqueous Solution (B) were taken out with a micropipette and applied dropwise to the surface of a photographic material to be tested, whereupon a commercial plane type pH-measuring glass electrode (whose part to be used for measurement has a diameter of 8 mm) was lightly pressed to the area to which the above-mentioned Aqueous Solution (B) had been dropwise applied, and the pH value of the area was measured at 25° C.±2° C. The pH value as measured 45 seconds after dropwise application of Aqueous Solution (B) to the area is called the "alkali-swelled film pH value" in the present invention. In this procedure, the area to which 20 microliters of Aqueous Solution (B) had been adhered was 0.5 $cm^2$. In other words, this means that 400 ml of Aqueous Solution (B) would be applied to one mz of the photographic material. Regarding the alkali content in the aqueous solution used for the measurement, 40 ml of Aqueous Solution (A) would be applied to one $m^2$ of the photographic material.

Aqueous Solution (A) as used in the above-mentioned method has an alkali component which is almost the same as that in a conventional color developer (usually having a pH of about 9.5 to 10.5), such as employed in the Examples of the present invention described below. Additionally, the amount of the above-mentioned Aqueous Solution (A) used for the measurement, 40 ml, is almost the same as the amount of the developer that would be absorbed into the photographic layer of one $m^2$ of the photographic material of the invention by swelling of the material with the developer. Accordingly, the "alkali-swelled film pH value" as referred to herein indicates the film pH value of the photographic material after the alkali solution (developer) has penetrated into the photographic layer immediately after initiation of development of the material and has been neutralized in the layer by some components therein. In a conventional development period of longer than 20 seconds, the photographic light-sensitive material being developed is washed with a large amount of a developer after the above-mentioned initial neutralization reaction and therefore development proceeds under the condition that the film pH value of the photographic light-sensitive layer has become virtually the same as the pH value of the developer used. However, in the high-speed development of the present invention to be effected in an extremely shortened period of time, such a washing step can not be effected sufficiently; thus, the amount of the alkali agent applied is only that which initially penetrates into the photographic light-sensitive material. Therefore, the alkali-swelled film pH value as defined above and referred to herein has a significant meaning in the method of the present invention.

If the alkali-swelled film pH value is less than 9.0, development is delayed and the effects of the present invention are small. Accordingly, in order to realize the full effects of the present invention, the alkali-swelled film pH value is at least 9.0, preferably at least 9.40 and preferably up to 12.0, and more preferably up to 11.4. One concrete means of maintaining the alkali-swelled film pH value at 9.0 or more is, for example, to reduce the amount of gelatin to be coated. In addition to gelatin, all compounds having a dissociating group have some influence on the alkali-swelled pH value. Therefore, means for controlling the value is not limitative at all. Preferably, the total amount of compounds which are be dissociated at a pH value of from 6.0 to 10.0 in the photographic material to be processed by the method of the present invention, is minimized as much as possible.

The transferring speed of the photographic material in the developing solution is preferably from 0.1 to 10 m/min.

In the present invention development is carried out by stirring the development solution using a jet stream in order to prevent unevenness of proceeding of development in the photographic material sheet and accelerate the development which result in to obtain a color image with high qualities.

The jet stream is usually provided using nozzles or slits arranged vertically to the direction of the transferring direction of the photographic material. It is preferred that at least one line of nozzels or at least one slit is provided in the developing solution at an optional position.

The contacting angle of the jet stream to the surface of the photographic material is preferably at least 30° measured from the surface (having no reverse vector component to the transferring direction), more preferably is from 45° to 90°.

The jet stream employed in the method of the present invention may be formed, for example, by sucking the processing solution from the processing bath by a pump and jetting it against the surface of the light-sensitive layer of the photographic material being processed from nozzles or slits provided in positions facing the light-sensitive layer of the material. More precisely, the method described in JP-A-62-183460, from page 3, right lower column to page 4, right lower column may be used.

The speed of the jet stream as it collides against the surface of the light-sensitive layer of the photographic material being processed is preferably as high as possible within the range of not interfering with the conveyance of the material. Preferably, the speed falls within the range of from 0.3 to 3 m/sec, more preferably from 0.5 to 2.0 m/sec, and most preferably from 0.6 to 1.5 m/sec.

In the present invention, the apparatus (of JP-A-62-183460) shown in FIG. 1 is preferably used for the development. In FIG. 1, 1 is a color developing bath, 2 is a hang-roller, 3 is a chamber for forming a high speed jet stream, 4 is a mean having plural slits, 5 is a hang-roller, 6 is a negative film, 7 is a liquid supplying tube and 8 is a pump.

The color photographic material to be processed by the method of the present invention comprises a support having provided thereon at least one blue-sensitive silver halide emulsion layer, at least one green-sensitive silver halide emulsion layer and at least one red-sensitive silver halide emulsion layer. In an ordinary color photographic paper, light-sensitive silver halide layers are generally coated on the support in the order as mentioned above. However, any other order than the above-mentioned one may also be employed in the present invention. Additionally, an infrared-sensitive silver halide emulsion layer may be employed in place of at least one of the above-mentioned emulsion layers. Each of these light-sensitive emulsion layers contains a silver halide emulsion having a sensitivity in the relevant wavelength range and a so-called color coupler capable of forming a dye which is complementary to the color of the sensitive light; that is, yellow to blue, magenta to green, and cyan to red, whereby the respective layers may reproduce the intended colors by subtractive color photography. However, the combination of the light-sensitive layer and the coloring hue of the coupler therein is not limited to only the above-mentioned constitutions.

The silver halide emulsion for use in the present invention preferably comprises silver chlorobromide or silver chloride which is substantially free of silver iodide. The silver halide which is substantially free of silver iodide as referred to herein means that the silver iodide content in the halide is 0.1 mol % or less, preferably 0.02% or less. The halogen composition in the silver halide grains in the emulsion may differ between individual grains or may be the same. Use of an emulsion where the halogen composition is the same in the silver halide grains therein facilitates uniformity of the properties of the respective grains in the emulsion. Regarding the halogen composition distribution in the inside of the respective silver halide emulsion grains, so-called uniform structural grains where the halogen composition is the same in any portion of the silver halide grains, or so-called laminate structural grains where the halogen composition differs from each other between the core of the inside of the silver halide grain and the shell surrounding the core (the shell being composed of one layer or plural layers), or composite structural grains which have different non-layered halogen composition portions in the inside or surface of the grain (where such different non-layered halogen composition portions are on the surface of the grain, the different composition portions are conjugated on the edges, corners or planes thereof) may properly be selected for use in the present invention. The latter two types of grains (laminate grains, composite grains) are preferred to the first described uniform structural grains for the purpose of obtaining a higher sensitivity and also in view of retarding pressure-marks. Where the silver halide grains for use in the present invention have any one of the above-mentioned structures, the boundary between the portions each having a different halogen composition may be either a definite boundary or an indefinite boundary to form a mixed crystal due to the difference in the halogen compositions. Additionally, between different compositions the structure may be positively made continuous variation.

The halogen composition of the silver chlorobromide in an emulsion to be employed for preparing the photographic material of the present invention has a silver chloride content of 95 mol % or more. More preferably, the silver chloride content in the silver chlorobromide is 98 mol % or more.

In the high content silver chloride emulsion used in the present invention, the grains preferably have a silver bromide-localized phase structure where a silver bromide-localized phase exists in the inside and/or on the surface of the silver halide grain in the form of a layer or non-layer as mentioned above. The halogen composition in the localized phase preferably comprises at least 10 mol % silver bromide, more preferably more than 20 mol % thereof. The ocalized phase may be in the inside of the grain or on the edges, corners or planes of the surface of the grain. As one preferred embodiment, the phase may grow on the corners of the grain as epitaxial growth.

For forming the above-mentioned localized phase, any one of a halogen-conversion method of using a water-soluble bromide or a method blending the grains with small-sized silver bromide grains, for example, as described in EP0273430, may be employed. However, formation of the localized phase is not limited to any particular method.

On the other hand, for the purpose of suppressing lowering of the sensitivity when the photographic material has received pressure, even the high content silver chloride grains having a silver chloride content of 95 mol % or more preferably has a uniform structure having a narrow halogen composition distribution therein.

For the purpose of reducing the amount of the replenisher of the developer to be used for processing the photographic material, further elevation of the silver chloride content in the silver halide emulsion is effective. In such a case, an emulsion comprising almost pure silver chloride grains having a silver chloride content of from 98 mol % to 100 mol % may be preferably employed.

The mean grain size of the silver halide grains contained in the silver halide emulsion for use in the present invention is preferably is from 0.25 μm to 0.75 μm, and more preferably is from 0.3 μm to 0.7 μm. (The grain size corresponds to the diameter of a circle having the same projection area of the grain, and the mean grain size corresponds to the number average value of the respective grain sizes).

Regarding the grain size distribution, a so-called monodispersed emulsion is preferred, which has a fluctuation coefficient (obtained by dividing the standard deviation of the grain size distribution by the mean grain size) of 20% or less, preferably 15% or less. In the photographic material processed in the present invention, it is also preferred that different mono-dispersed emulsions be blended and incorporated into the same layer, or they may be incorporated into two or more different layers to be laminated. for the purpose of obtaining a broad photographic latitude.

In the photographic emulsion layers constituting the photographic material to be processed by the present invention, the ratio of the silver halide mean grain size calculated for each photographic emulsion layer to that as calculated for any other layer is from 0.77/1 to 1.3/1, preferably from 0.83/1 to 1.2/1. If the ratio is outside the defined range, fluctuation of the tone-reproducibility of the photographic material being processed is too great and the effects of the present invention are not attained.

The silver halide grains in the photographic emulsion may have a regular crystalline form such as cubic, octahedral or tetradecahedral crystalline form, or may have an irregular crystalline form such as spherical or tabular crystalline form, or may have a composite form of such various crystal forms. Additionally, the emulsion may contain various grains having different crystalline forms. In the present invention, it is preferred that the content of the above-mentioned regular crystalline grains is 50% or more, more preferably 70% or more, especially preferably 90% or more, in the emulsion.

Additionally, an emulsion containing tabular grains having a mean aspect ratio (ratio of circle-corresponding diameter/thickness) of 5 or more, preferably 8 or more, in a proportion of more than 50% of the total grains as the projected area, may be preferably employed in the present invention.

The silver chloride or silver chlorobromide emulsion for use in the present invention can be prepared by the methods described in P. Glafkides, *Chimie et Phisique Photographique* (published by Paul Montel Co. in 1967), G. F. Duffin, *Photographic Emulsion Chemistry* (published by Focal Press Co. in 1966) and V. L. Zelikman et al, *Making and Coating Photographic Emulsion* (published by Focal Press Co. in 1964). More particularly, the emulsion may be prepared by any of an acid method, a neutral method or an ammonia method. Where it is prepared in a system in which a soluble silver salt and soluble halides are reacted, any method from among a single jet method, a double jet method and a combination thereof may be employed. A so-called reversed jet method where the grains are formed in the presence of excess silver ions may also be employed. As one system of the double jet method, a so-called controlled double jet method where the pAg value in the liquid phase of forming silver .halide grains is kept constant may also be employed. According to this method, silver halide grains having regular crystalline forms and having almost uniform grain sizes can be obtained.

Various polyvalent metal ion impurities may be introduced into the silver halide emulsion for use in the present invention, in the step of forming the grains or of physical ripening thereof. Examples of compounds usable for this purpose include salts of cadmium, zinc, lead, copper or thallium, as well as salts or complex salts of elements of Group VIII in the Periodic Table, such as iron, ruthenium, rhodium, palladium, osmium, iridium or platinum. In particular, the elements of Group VIII are preferably employed. The amount of the compound to be added to the emulsion may widely vary in accordance with the desired objects, but it is preferably from $10^{-9}$ to $10^{-2}$ mol per mol of the silver halide in the emulsion.

The silver halide emulsion for use in the present invention is generally chemically-sensitized or color-sensitized.

For chemical sensitization of the emulsion, sulfur sensitization by typically adding an unstable sulfur compound to the emulsion, noble metal sensitization such as gold sensitization, as well as reduction sensitization can be employed singly or in combination. The compounds preferably employed in such chemical sensitization methods are described in JP-A-62-215272, from page 18, right-lower column to page 22, right-upper column.

Spectral sensitization is effected for the purpose of imparting spectral sensitivity in the desired light wavelength range to the emulsions of the respective layers of the photographic material of the present invention. In accordance with the present invention, such spectral sensitization is preferably effected by adding a dye (spectral-sensitizing dye) which absorbs the light with a wavelength range corresponding to the intended spectral sensitivity of the photographic emulsion. Examples of the spectral-sensitizing dyes usable for this purpose include the compounds described in F. M. Harmer, *Heterocyclic Compounds—Cyanine Dyes and Related Compounds* (published by John Wiley & Sons Co. of New York, London, in 1964). Specific examples of such compounds are also described in the above-mentioned JP-A-62-215272, from page 22, right-upper column to page 38, and these sensitizing dyes are preferably employed in the present invention.

The silver halide emulsion for use in the present invention can contain various compounds or precursors thereof for the purpose of preventing fog or for stabilizing the photographic properties of the materials during manufacture of the photographic materials, storage thereof or photographic processing thereof. Specific examples of the compounds which are preferably used for these purposes are described in the above-mentioned JP-A-62-215272, pages 39 to 72.

The emulsion for use in the present invention may be either a so-called surface latent image type emulsion which forms a latent image essentially on the surfaces of the grains or a so-called internal latent image type emulsion which forms a latent image essentially in the insides of the grains.

The color photographic material to be processed by the method of the present invention generally contains yellow couplers, magenta couplers and cyan couplers which form yellow, magenta and cyan colors, respectively, by being coupled with the oxidation product of an aromatic amine color developing agent.

Cyan couplers, magenta couplers and yellow couplers which are preferably employed in the present invention include those represented by the following general formulae ((C-I), (C-II), (M-I), (M-II) and (Y):

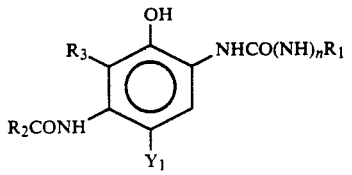

(C-I)

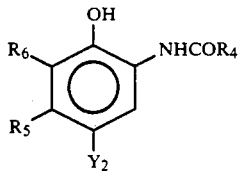

(C-II)

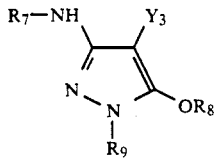

(M-I)

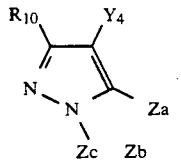

(M-II)

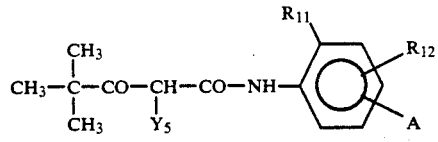

(Y)

In formulae (C-I) and (C-II), $R_1$, $R_2$ and $R_4$ independently represent a substituted or unsubstituted aliphatic, aromatic or heterocyclic group; $R_3$, $R_5$ and $R_6$ independently represent a hydrogen atom, a halogen atom, an aliphatic group, an aromatic group or an acylamino group; and $R_3$ may form, along with $R_2$, a non-metallic atomic group for forming a nitrogen-containing 5-membered or 6-membered ring. $Y_1$ and $Y_2$ independently represent a hydrogen atom or a group capable of being released upon a coupling reaction with the oxidation product of a developing agent. n represents 0 or 1.

In formula (C-II), $R_5$ is preferably an aliphatic group, for example, methyl, ethyl, propyl, butyl, pentadecyl, tertbutyl, cyclohexyl, cyclohexylmethyl, phenylthiomethyl dodecyloxyphenylthiomethyl, butanamidomethyl or methoxymethyl group.

Preferred examples of cyan couplers represented by the above-mentioned general formulae (C-I) and (C-II) are as follows:

In formula (C-I), $R_1$ is preferably an aryl group or a heterocyclic group, and is more preferably an aryl group substituted by one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group.

In formula (C-I), where $R_3$ does not form a ring along with $R_2$, $R_2$ is preferably a substituted or unsubstituted alkyl or aryl group and is especially preferably a substituted aryloxy-substituted alkyl group, and $R_3$ is preferably a hydrogen atom.

In formula (C-II), $R_4$ is preferably a substituted or unsubstituted alkyl or aryl group and is especially preferably a substituted aryloxy-substituted alkyl group.

In formula (C-II), $R_5$ is preferably an alkyl group having from 2 to 15 carbon atoms or a methyl group having one or more substituents having at least one carbon atom. As substituents on the methyl group, for example, an arylthio group, an alkylthio group, an acylamino group, an aryloxy group and/or an alkyloxy group are preferred.

In formula (C-II), $R_5$ is more preferably an alkyl group having from 2 to 15 carbon atoms and is most preferably an alkyl group having from 2 to 4 carbon atoms.

In formula (C-II), $R_6$ is preferably a hydrogen atom or a halogen atom and is especially preferably a chlorine or fluorine atom.

In formulae (C-I) and (C-II), $Y_1$ and $Y_2$ each are preferably a hydrogen atom, a halogen atom, an alkoxy group, an aryloxy group, an acyloxy group or a sulfonamido group.

In formula (M-I), $R_7$ and $R_9$ independently represent an aryl group; $R_8$ represents a hydrogen atom, an aliphatic or aromatic acyl group, or an aliphatic or aromatic sulfonyl group; and $Y_3$ represents a hydrogen atom or a releasing group. The aryl group represented by $R_7$ and $R_9$ is preferably a phenyl group and may be a substituted one. Regarding the substituents on the aryl group, those mentioned above on the group $R_1$ may be referred to. Where the aryl group has two or more substituents, the substituents may be the same or different. $R_8$ is preferably a hydrogen atom, or an aliphatic acyl or sulfonyl group, and it is especially preferably a hydrogen atom. $Y_3$ is preferably a releasing group which may be released from the molecule at the position of a sulfur, oxygen or nitrogen atom. For example, sulfur atom-releasing groups as described in U.S. Pat. No. 4,351,897 and International Patent Application Laid-Open W088/04795 are especially preferred. The coupler of formula (M-I) may form a dimer or polymer at the position of $R_7$.

In formula (M-II), $R_{10}$ represents a hydrogen atom or a substituent; $Y_4$ represents a hydrogen atom or a releasing group. $Y_4$ is especially preferably a halogen atom or an arylthio group. Za, Zb and Zc independently represent a methine group, a substituted methine group, =N— or —NH—; and one of the Za-Zb bond and the Zb-Zc bond is a double bond and the other is a single bond. Where Zb-Zc bond is a carbon-carbon double bond, it may form a part of an aromatic ring. The coupler of formula (M-II) may form a dimer or polymer at the position of $R_{10}$ or $Y_4$ or at the position of Za, Zb or Zc when this group is a substituted methine group.

Among the pyrazoloazole couplers represented by formula (M-II), imidazo[1,2-b] pyrazoles described in U.S. Pat. No. 4,500,630 are preferred as giving color dyes having a small yellow side-absorption and having a high light-fastness. In particular, pyrazolo[1,5-b][1,2,4] triazoles described in U.S. Pat. No. 4,540,654 are especially preferred.

Additionally, pyrazolotriazole couplers where a branched alkyl group is directly bonded to the 2-, 3- or 6-position of the pyrazolotriazole ring, as described in JP-A-61-65245; pyrazoloazole couplers having a sulfonamido group in the molecule, as described in JP-A-61-65246; pyrazoloazole couplers having an alkoxyphenylsulfonamido ballast group, as described in JP-A-61-147254; as well as pyrazolotriazole couplers having an alkoxy or aryloxy group at the 6-position, as described in European Patent Nos. 226,849 and 294,785 are preferably employed.

In formula (Y), $R_{11}$ represents a halogen atom, an alkoxy group, a trifluoromethyl group or an aryl group; $R_{12}$ represents a hydrogen atom, a halogen atom or an alkoxy group. A represents $—NHCOR_{13}$, $—NHSO_2—R_{13}$, $—SO_2NHR_{13}$, $—COOR_{13}$ or $—SO_2N(R_{14})(R_{13})$; where $R_{13}$ and $R_{14}$ independently represent an alkyl group, an aryl group or an acyl group. $Y_5$ represents a releasing group. The groups $R_{12}$, $R_{13}$ and $R_{14}$ may optionally be substituted. Regarding the substituents on the groups, those on the above-mentioned group $R_1$ may be referred to. $Y_5$ is a releasing group which may be removed from the molecule via an oxygen atom or nitrogen atom. Especially preferably, it is a nitrogen atom-releasing group.

Specific examples of couplers of formulae (C-I), (C-II), (M-I), (M-II) and (Y) are mentioned below.

(C-1)

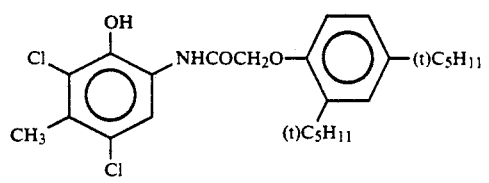

(C-2)

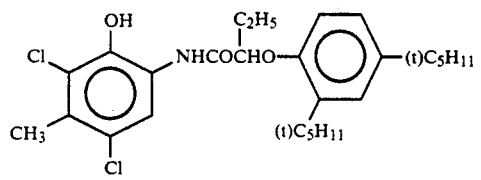

(C-3)

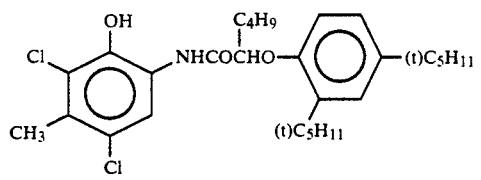

(C-4)

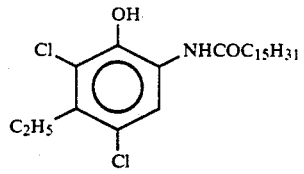

(C-5)

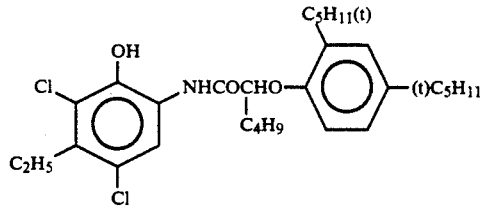

(C-6)

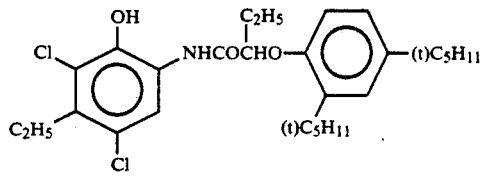

-continued
(C-7)
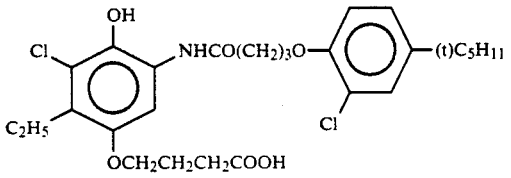
(C-8)
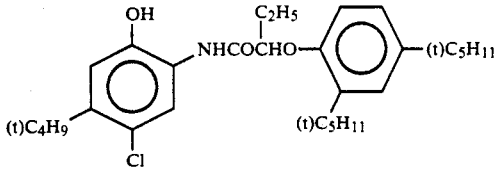
(C-9)
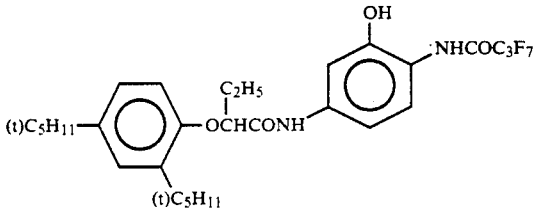
(C-10)
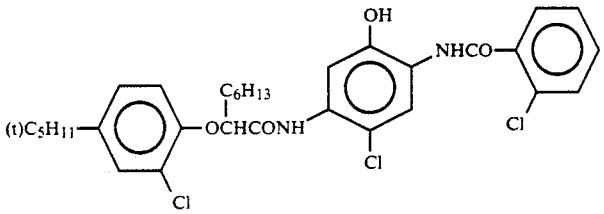
(C-11)
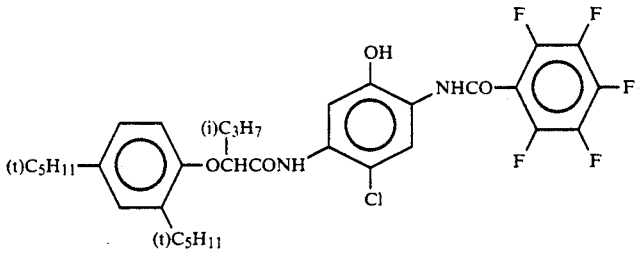
(C-12)
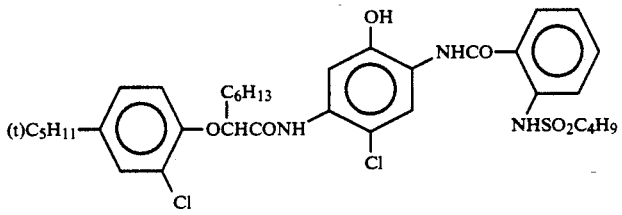
(C-13)
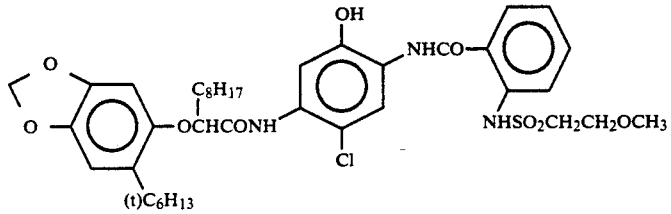

-continued
(C-14)
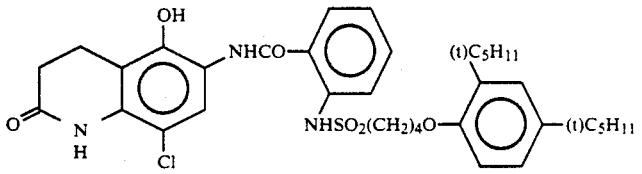
(C-15)
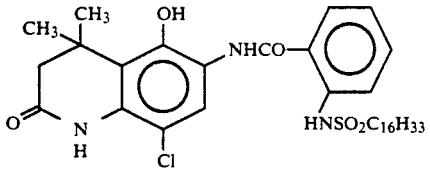
(C-16)
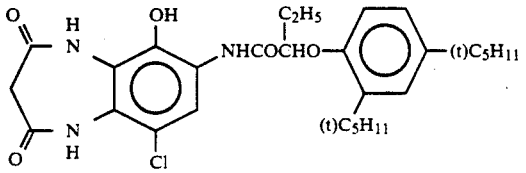
(C-17)
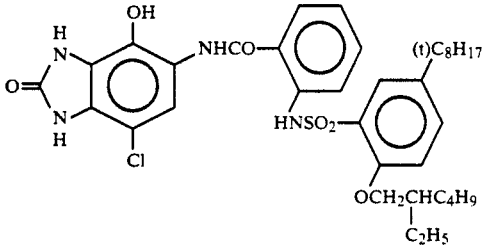
(C-18)
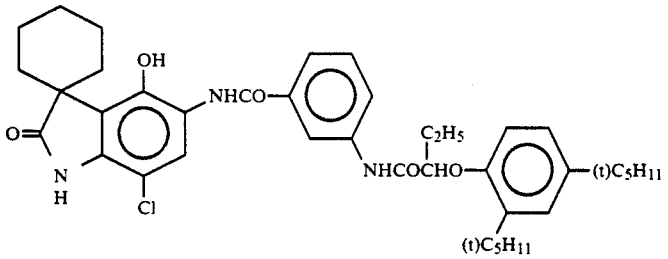
(C-19)
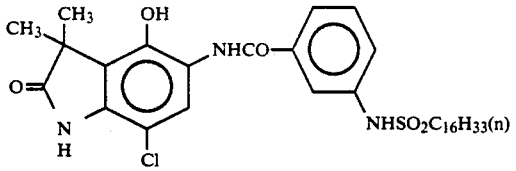
(C-20)
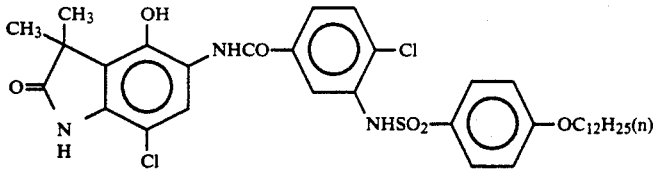
(C-21)
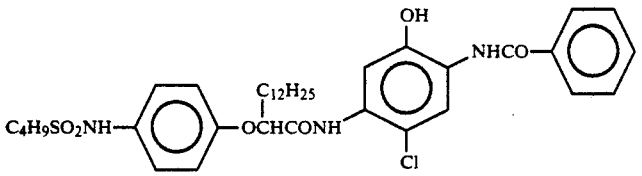

-continued
(C-22)
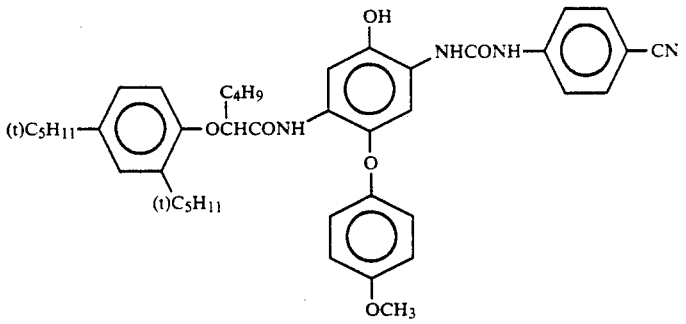
(M-1)
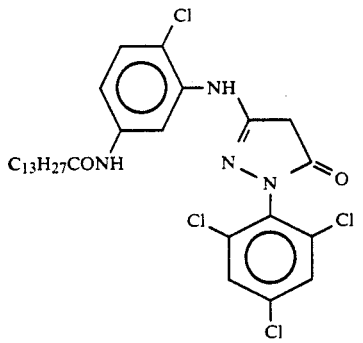
(M-2)
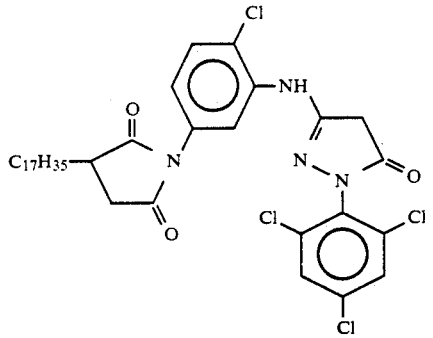
(M-3)
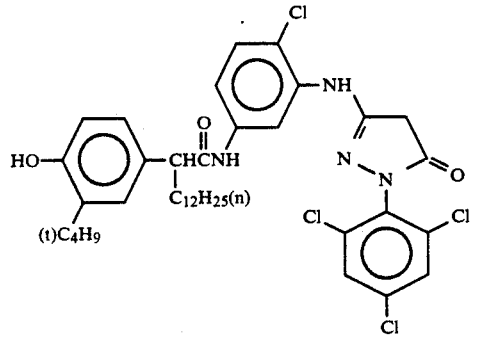

-continued
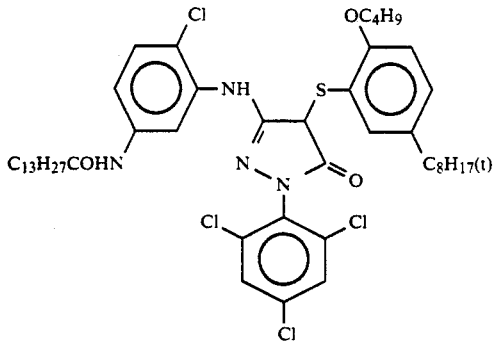
(M-4)
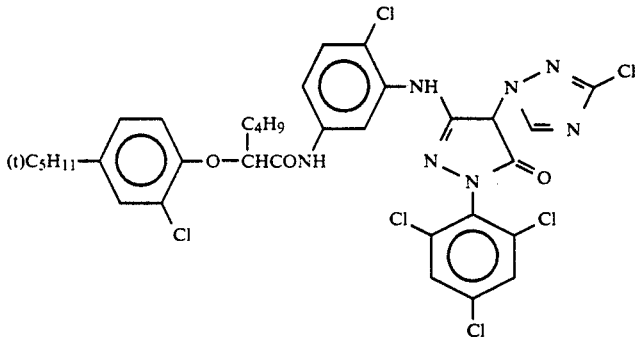
(M-5)
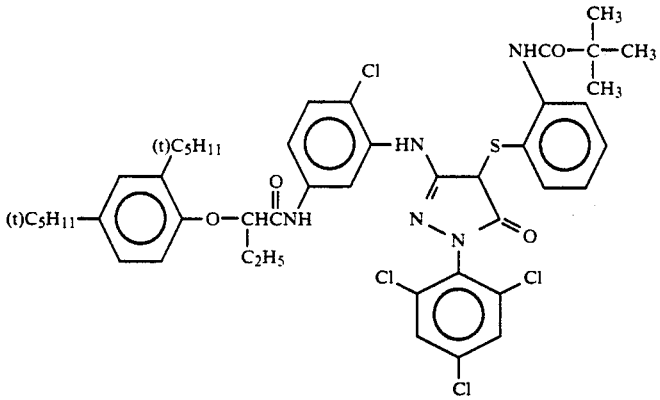
(M-6)
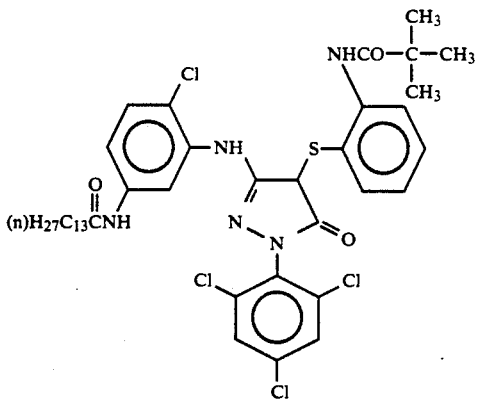
(M-7)

-continued
(M-8)
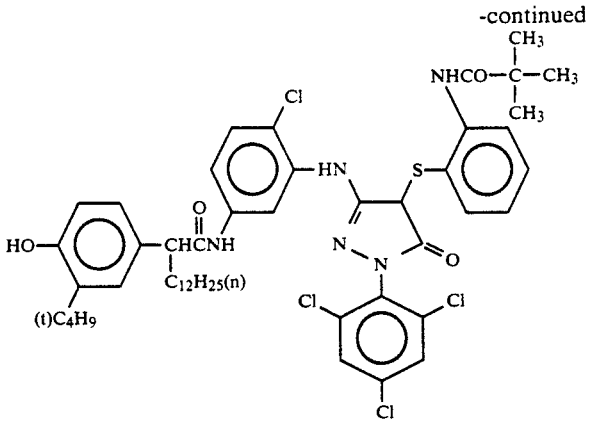

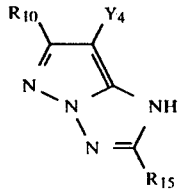
| Compound | $R_{10}$ | $R_{15}$ | $Y_4$ |
|---|---|---|---|
| M-9 | $CH_3$— | 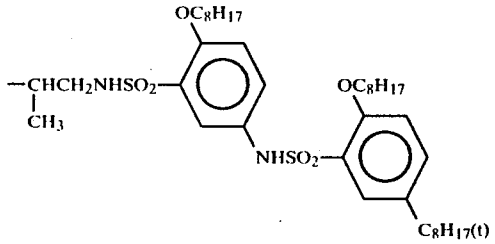 | Cl |
| M-10 | " | 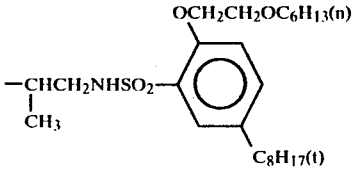 | " |
| M-11 | $(CH_3)_3C$— | 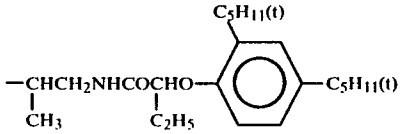 | 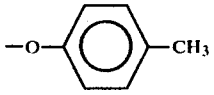 |
| M-12 | 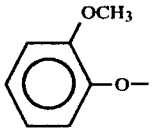 | 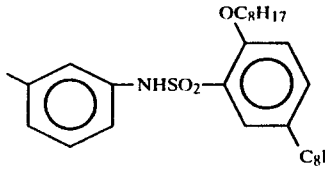 | 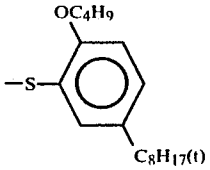 |

-continued
| | | | |
|---|---|---|---|
| M-13 | $CH_3$— | 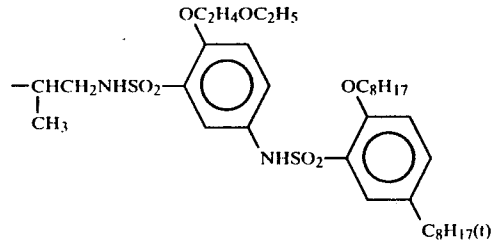 | Cl |
| M-14 | " | 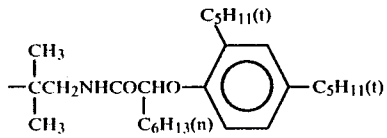 | " |
| M-15 | $CH_3$— | 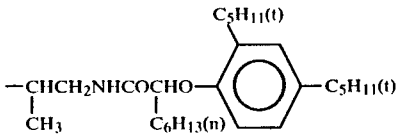 | Cl |
| M-16 | " | 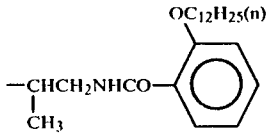 | " |
| M-17 | " | 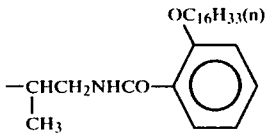 | " |

-continued
| | | | |
|---|---|---|---|
| M-18 | 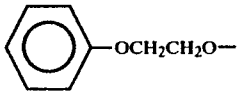 | 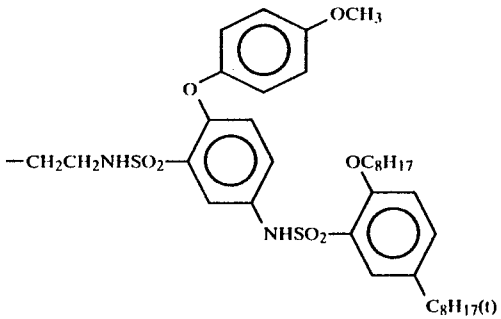 | 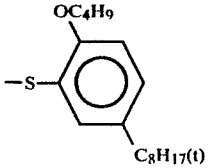 |
| M-19 | $CH_3CH_2O-$ | " | " |
| M-20 | 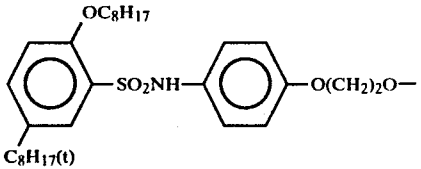 | 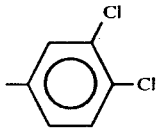 | 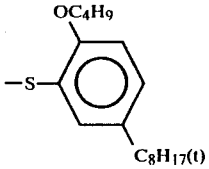 |
| M-21 | 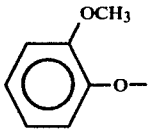 | 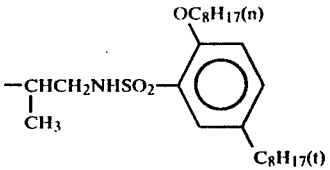 | Cl |
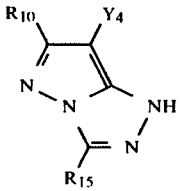
| Compound | $R_{10}$ | $R_{15}$ | $Y_4$ |
|---|---|---|---|
| M-22 | $CH_3-$ | 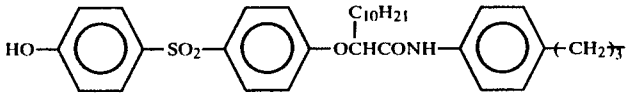 | Cl |

-continued
| | | | |
|---|---|---|---|
| M-23 | " | 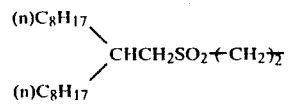 | " |
| M-24 | 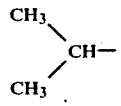 | 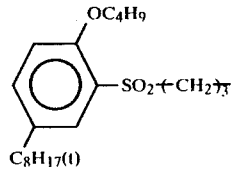 | " |
| M-25 | 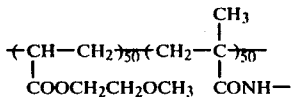 (Suffixes of parenthesis show molar ratio) | 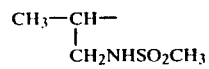 | " |
| M-26 | 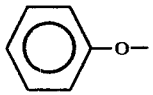 | 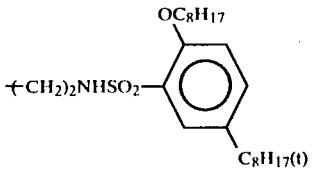 | Cl |
| M-27 | $CH_3$— | 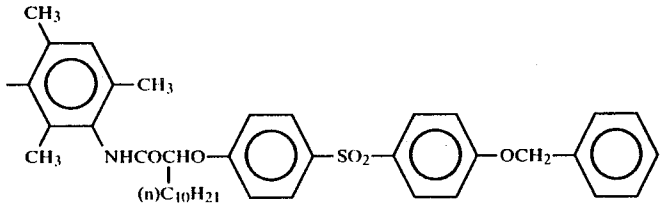 | " |
| M-28 | $(CH_3)_3C$— | 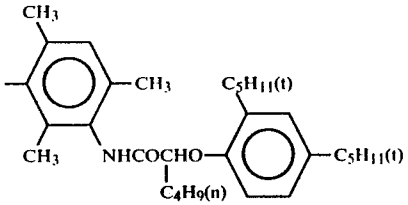 | " |

-continued
| | | | |
|---|---|---|---|
| M-29 | 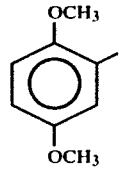 | 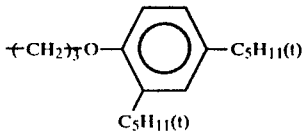 | Cl |
| M-30 | $CH_3$— | $-CH(C_2H_5)-N(n\text{-}C_{18}H_{37})COCH_2CH_2COOH$ | " |

(Y-1)
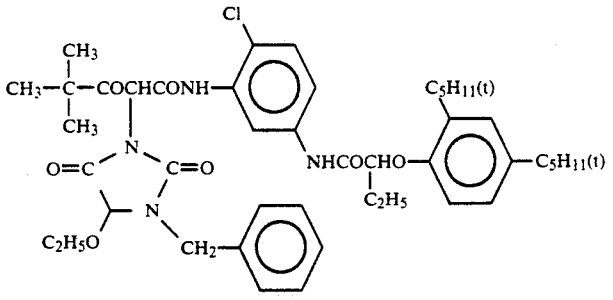
(Y-2)
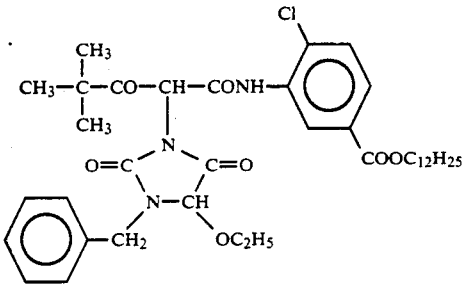
(Y-3)
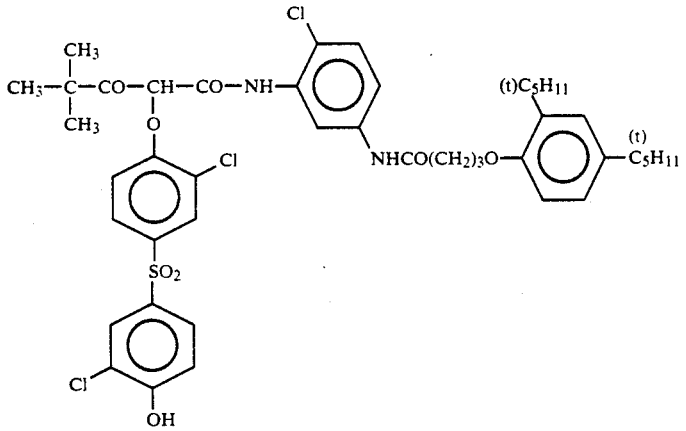
(Y-4)
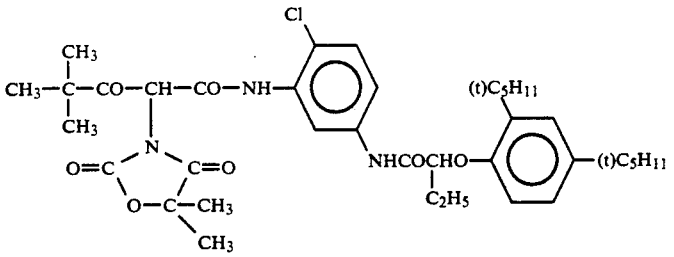
(Y-5)
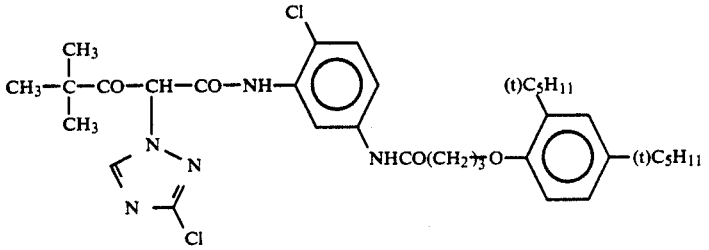

-continued (Y-6)

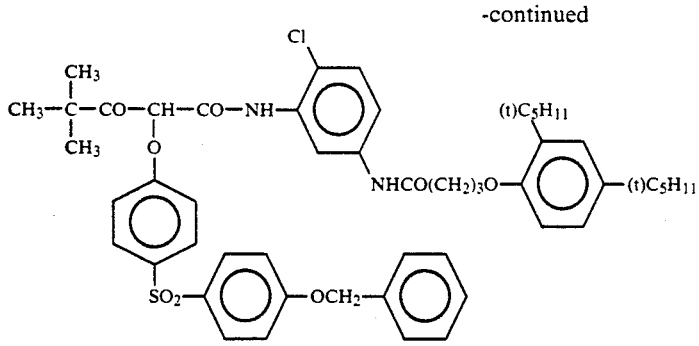

(Y-7)

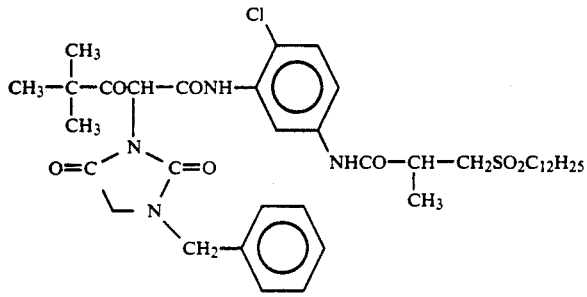

(Y-8)

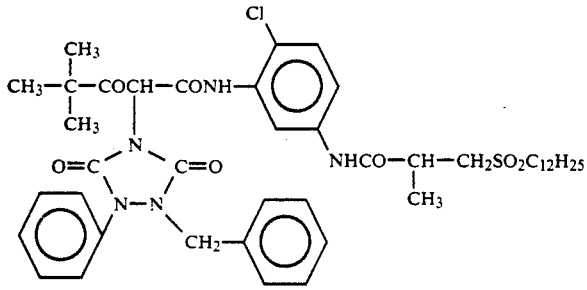

(Y-9)

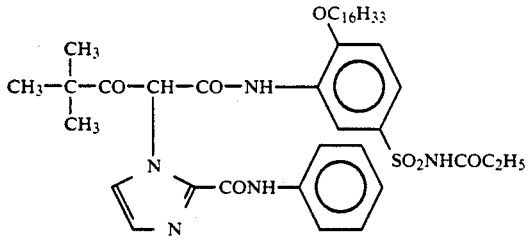

The couplers represented by any one of the above-mentioned formulae (C-I) to (Y) are incorporated into the silver halide emulsion layers, thus providing photographic light-sensitive layers of the photographic material of the present invention, in an amount of from 0.1 to 1.0 mol, preferably from 0.1 to 0.5 mol, per mol of the silver halide in the layer.

In accordance with the present invention, various known techniques can be employed for the purpose of adding the above-mentioned couplers to the light-sensitive layers. In general, an oil-in-water dispersion method which is known as an oil-protect method may be employed for this purpose, where the coupler is dissolved in a solvent and the resulting solution is dispersed by emulsification in an aqueous gelatin solution containing a surfactant. Alternatively, water or an aqueous gelatin solution may be added to a coupler solution containing a surfactant to form an oil-in-water dispersion by phase conversion. Alkali-soluble couplers many also be dispersed by a so-called Fisher dispersion method. The low boiling point organic solvent, if any, may be removed from the resulting coupler dispersion by distillation, noodle washing or ultrafiltration, and the dispersion may then be blended with the photographic emulsion.

As the dispersion medium for such couplers, a high boiling point organic solvent and/or a water-insoluble high polymer compound having a dielectric constant (at 25° C.) of from 2 to 20 and a refractive index (at 25° C.) of from 1.5 to 1.7 are preferably employed in the present invention.

Suitable high boiling point organic solvents include those represented by the following formulae (A) to (E):

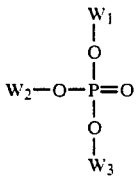
(A)

$W_1-COO-W_2$ (B)

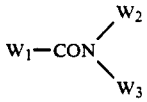
(C)

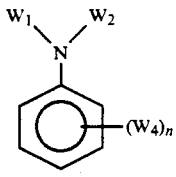
(D)

$W_1-O-W_2$ (E)

In these formulae, $W_1$, $W_2$ and $W_3$ each represent a substituted or unsubstituted alkyl, cycloalkyl, alkenyl, aryl or heterocyclic group, $W_4$ represents $W_1$, $OW_1$ or $SW_1$, n represents an integer of from 1 to 5; and when n is 2 or more, plural W4's may be the same or different. In the formula (E), $W_1$ and $W_2$ may together form a condensed ring.

In the present invention, any other high boiling point organic solvents than those of the above-mentioned formulae (A) to (E) may also be employed, provided that they are water-immiscible compounds having a melting point of 100° C. or lower and a boiling point of 140° C. or higher, and that they are good solvents to the couplers used in the present invention. The high boiling point organic solvents employed in the present invention preferably have a melting point of 80° C. or lower and a boiling point of 160° C. or higher, more preferably 170° C. or higher.

The details of such high boiling point organic solvents are described in JP-A-62-215272, from page 137, right-lower column to page 144, right-upper column.

The couplers of the present invention may also be incorporated into a loadable latex polymer in the presence or absence of the above-mentioned high boiling point organic solvent (for example, as described in U.S. Pat. No. 4,203,716) or dissolved in a water-insoluble and organic solvent-soluble polymer, and the resulting latex polymer may be dispersed by emulsification into the aqueous hydrophilic colloid solution.

Preferably, the homopolymers or copolymers described in International Patent Application Laid-Open No. W088/00723, pages 12 to 30 are used for the above-mentioned means, and use of acrylamide polymers is especially preferred in view of stabilization of the images to be formed.

The photographic material of the present invention can contain hydroquinone derivatives, aminophenol derivatives, gallic acid derivatives or ascorbic acid derivatives as a color-fogging inhibitor.

The photographic material of the present invention can contain various anti-fading agents. Typical examples of organic anti-fading agents which can be used for protecting cyan, magenta and/or yellow images include hindered phenols such as hydroquinones, 6-hydroxychromans, 5-hydroxycoumarans, spirochromans, p-alkoxyphenols or bisphenols, as well as gallic acid derivatives, methylenedioxybenzenes, aminophenols and hindered amines and also ether or ester derivatives thereof formed by silylating or alkylating the phenolic hydroxyl group of the compounds. Further, metal complexes such as (bissalicylaldoximato)nickel complexes and (bis-N,N-dialkyldithiocarbamato)nickel complexes can also be used.

Specific examples of the organic anti-fading agents which can be used in the present invention are described in the following patent specifications.

Hydroquinones are described in U.S. Pat. Nos. 2,360,290, 2,418,613, 2,700,453, 2,701,197, 2,728,659, 2,732,300, 2,735,765, 3,982,944, 4,430,425, British Patent 1,363,921 and U.S. Pat. Nos. 2,710,801, 2,816,028; 6-hydroxychromans, 5-hydroxycoumarans and spirochromans are described in U.S. Pat. Nos. 3,432,300, 3,573,050, 3,574,627, 3,698,909, 3,764,337 and JP-A-52-152225; spiroindanes are described in U.S. Pat. No. 4,360,589; p-alkoxyphenols are described in U.S. Pat. No. 2,735,765, British Patent 2,066,975, JP-A-59-10539 and JP-B-57-19765; hindered phenols are described in U.S. Pat. No. 3,700,455, JP-A-52-72224, U.S. Pat. No. 4,228,235 and JP-B-52-6623; gallic acid derivatives, methylenedioxybenzenes and aminophenols are described in U.S. Pat. Nos. 3,457,079, 4,332,886 and JP-B-56-21144; hindered amines are described in U.S. Pat. Nos. 3,336,135, 4,268,593, British Patents 1,326,889, 1,354,313, 1,410,846, JP-B-51-1420, JP-A-58-114036, JP-A-59-53846 and JP-A-59-78344; and metal complexes are described in U.S. Pat. Nos. 4,050,938, 4,241,155 and British Patent 2,027,731(A). These compounds may be added to the light-sensitive layer in an amount of, generally, from 5 to 100% by weight based on the corresponding coupler, by co-emulsifying the same along with the coupler, whereby the intended objects can be attained. In order to prevent the cyan color image from being deteriorated by heat and especially by light, it is more effective to add an ultraviolet absorbent to the cyan-coloring layer and the both adjacent layers.

Ultraviolet absorbents suitable for this purpose include, for example, aryl group-substituted benzotriazole compounds (for example, those described in U.S. Pat. No. 3,533,794), 4-thiazolidone compounds (for example, those described in U.S Pat. Nos. 3,314,794 and 3,353,681), benzophenone compounds (for example, those described in JP-A-46-2784), cinnamic acid ester compounds (for example, those described in U.S. Pat. Nos. 3,705,805 and 3,707,395), butadiene compounds (for example, those described in U.S. Pat. No. 4,045,229), and benzoxidol compounds (for example, those described in U.S. Pat. Nos. 3,406,070, 3,677,672 and 4,271,307). Additionally, ultraviolet-absorbing couplers (for example, cyan dye-forming alpha-naphthol couplers) or ultraviolet-absorbing polymers may also be employed. Such ultraviolet absorbents may be mordanted in particular layers of the photographic material of the invention.

The above-mentioned aryl group-substituted benzotriazole compounds are most preferred.

Along with the above-mentioned couplers, the compounds mentioned below are especially preferably employed. These are especially preferably combined with pyrazoloazole couplers.

Specifically, compounds (F) (described below) which may chemically bond with the aromatic amine developing agent remaining after color development to give a chemically inactive and substantially colorless compound and/or compounds (G) (described below) which may chemically bond with the oxidation product of the aromatic amine developing agent remaining after color development to give a chemically inactive and substantially colorless compound, are preferably employed simultaneously or singly. Use of such compounds is preferred, for example, for preventing stains caused by formation of colored dyes by reaction between the developing agent or the oxidation product thereof remaining in the film and the coupler also remaining therein during storage of the material as processed, and also for preventing other harmful side-reactions.

Preferred compounds (F) react with p-anisidine with a secondary reaction speed constant k2 (in trioctyl phosphate at 80° C.) of from 1.0 liter/mol sec to $1\times10^{-5}$ liter/mol.sec. The secondary reaction speed constant can be measured by the method described in JP-A-63-158545.

If the value k2 is larger than the above range, the compounds themselves would be unstable add would often react with gelatin and water to decompose. On the other hand, if it is smaller than the above range, the reaction speed of the compound with the remaining aromatic amine developing agent would be low and, as a result, preventing the harmful side effects due to the remaining aromatic amine developing agent, might not be attained.

More preferred examples of such compounds (F) are those represented by the following formula (FI) or (FII).

$$R_1-(A)_n-X \quad \text{(FI)}$$

$$R_2-\underset{\underset{B}{|}}{C}=Y \quad \text{(FII)}$$

In these formulae, $R_1$ and $R_2$ each represent an aliphatic group, an aromatic group or a heterocyclic group; n represents 1 or 0; A represents a group capable of reacting with an aromatic amine developing agent to form a chemical bond; X represents a releasable group capable of reacting with an aromatic amine developing agent; B represents a hydrogen atom, an aliphatic group, an aromatic group, a heterocyclic group, an acyl group or a sulfonyl group; and Y represents a group capable of accelerating addition of an aromatic amine developing agent to the compound of the formula (FII). $R_1$ and X, and Y and $R_2$ or B, may be bonded to each other to form a cyclic structure.

Typical methods of reacting these compounds and the remaining aromatic amine developing agent by chemical bond are a substitution reaction and an addition reaction.

Specific examples of the compounds of the formula (FI) and (FII) are described in JP-A-63-158545 and JP-A-62-283338 and European Patent Application Nos. 298321 and 277589, and are preferably employed in the present invention.

On the other hand, preferred compounds (G) which chemically bond with the oxidation product of the aromatic amine developing agent remaining after color development to give a chemically inert and substantially colorless compound, are those represented by the following formula (GI):

$$R-Z \quad \text{(GI)}$$

wherein R represents an aliphatic group, an aromatic group or a heterocyclic group; and Z represents a nucleophilic group or a group capable of releasing a nucleophilic group after being decomposed in the photographic material. In the compounds of the formula (GI), Z is preferably a group having a nucleophilic $nHC_3I$ value (R. G. Pearson, et al., *J. Am. Chem. Soc.*, 90, 319 (1968)) of 5 or more, or a derivatives therefrom.

Specific examples of the compounds of the formula (GI) are described in European Patent Application No. 255722, JP-A-62-143048 and JP-A-62-229145, Japanese Patent Application Nos. 63-136724 and 62-214681 and European Patent Application Nos. 298321 and 277589, and are preferably used in the present invention.

The details of the combination of the above-mentioned compounds (G) and compounds (F) are described in European Patent Application No. 277589.

The photographic material of the present invention can contain water-soluble dyes or dyes which may become water-soluble by photographic processing in the hydrophilic colloid layers as a filter dye, or for the purpose of anti-irradiation or anti-halation or for other various purposes. Such dyes include, for example, oxonole dyes, hemioxonole dyes, styryl dyes, merocyanine dyes, cyanine dyes and azo dyes. Oxonole dyes, hemioxonoles dyes and merocyanine dyes are preferred.

As the binder or protective colloid which can be used in the emulsion layer of the photographic material of the present invention, gelatin is advantageously used. However, any other hydrophilic colloid may also be employed singly or in combination with gelatin.

The gelatin to be used in the present invention may be either a lime-processed one or an acid processed one. The details of the preparation of such gelatins are described in Arther Vais, *The Macromolecular Chemistry of Gelatin* (published by Academic Press in 1964).

The support for use in the present invention may be a transparent or reflective film, such as a cellulose nitrate film or a polyethylene terephthalate film which are generally employed in ordinary photographic materials. Use of the latter reflective support is preferred in the present invention.

The reflective support which can be employed in the present invention is preferably one which may improve the reflectivity of the support so that the color image formed on the silver halide emulsion layer is made sharp. Such reflective supports include a support prepared by coating a hydrophobic resin which contains a dispersion of a light-reflecting substance such as titanium oxide, zinc oxide, calcium carbonate or calcium sulfate on a support base, or a support made of a hydrophobic resin which contains a dispersion of a light-reflecting substance. For instance, a baryta paper, a polyethylene-coated paper, a synthetic polypropylene paper, as well as a transparent support (e.g., glass sheet, polyester films such as polyethylene terephthalate, cellulose triacetate or cellulose nitrate, or polyamide films, polycarbonate films, polystyrene films or vinyl chloride resin films) coated with a reflective layer or containing a reflecting substance, may be used.

In addition, supports having a metal surface with mirror reflectivity or secondary diffusion-reflectivity may also be employed as the reflective support in preparing the photographic materials processed in the present invention. The metal surface is preferably one having a spectral reflectivity of 0.5 or more in the wavelength range of visible light, and it is also preferred to roughen the metal surface or to impart a diffusive reflectivity thereto by the use of a metal powder. Such metal may be selected from aluminum, tin, silver, magnesium and alloys thereof. The surface may be that of a metal sheet, metal foil or thin metal layer prepared by rolling, evaporation coating or plating. The metal surface is more preferably prepared by coating a metal over a substrate of a different material by evaporation coating. Provision of a water-resistant resin, especially a thermoplastic resin layer, over the metal surface is preferred. A support having the above-mentioned metal surface preferably has an antistatic layer on the other surface opposite to the metal surface. The details of such supports are described, for example, in JP-A-61-210346, JP-A-63-24247, JP-A-63-24251 and JP-A-63-24255.

The supports may properly be selected by one of ordinary skill in the art in accordance with the practical uses for the material.

The above-mentioned light-reflecting substance is preferably a white pigment fully kneaded in the presence of a surfactant, or pigment grains surface-treated with a 2- or 4-valent alcohol.

Where fine grains of a white pigment are incorporated into the support, the exclusive area ratio (%) of the grains per the unit area is obtained most typically by dividing the observed area into the adjacent unit area of 6 $\mu m \times 6$ $\mu m$, and then measuring the exclusive area ratio (%) (Ri) of the fine grains as projected to the unit area. The fluctuation coefficient of the exclusive area ratio (%) can be obtained as the ratio $s/\overline{R}$ of the standard deviation (s) of Ri to the mean value (R) of $\overline{R}i$. The number (n) of the unit areas for the measurement is preferably 6 or more. Accordingly, the fluctuation coefficient $s/\overline{R}$ can be obtained from the following formula:

$$\sqrt{\frac{\sum_{i=1}^{n}(Ri-R)^2}{n-1}} \Big/ \frac{\sum_{i=1}^{n} Ri}{n}$$

In accordance with the present invention, the fluctuation coefficient of the exclusive area ratio (%) of the fine pigment grains is preferably 0.15 or less, especially preferably 0.12 or less. If it is 0.08 or less, it can be said that the dispersibility of the grains is substantially "uniform".

In accordance with the method of the present invention, the color photographic material after image-wise exposure, is preferably color-developed, bleach-fixed and rinsed with water (or stabilized). Bleaching and fixation may be effected either simultaneously in a mono-bath, or separately in different bathes.

The color developer to be used for color development of the photographic material in accordance with the present invention contains a known aromatic primary amine color developing agent. Preferably, p-phenylenediamine derivatives are used as the developing agent, and specific examples thereof . are mentioned below. However, these are not limitative in any sense.

D-1: N,N-diethyl-p-phenylenediamine

D-2: 2-Amino-5-diethylaminotoluene

D-3: 2-Amino-5-(N-ethyl-N-laurylamino)toluene

D-4: 4-[N-ethyl-N-(β-hydroxyethyl)amino]aniline

D-5: 2-methyl-4-[N-ethyl-N-(8-hydroxyethyl)amino]-aniline

D-6: 4-Amino-3-methyl-N-ethyl-N-[8-(methanesulfonamido)ethyl]-aniline

D-7: N-(2-amino-5-diethylaminophenylethyl)methanesulfonamide

D-8: N,N-dimethyl-p-phenylenediamine

D-9 4-Amino-3-methyl-N-ethyl-N-methoxyethylaniline

D-10: 4-Amino-3-methyl-N-ethyl-N-β-ethoxyethylaniline

D-11: 4-Amino-3-methyl-N-ethyl-N-β-butoxyethylaniline

Among the above-mentioned p-phenylenediamine derivatives, especially preferred are 2-methyl-4-[N-ethyl-N-((β-hydroxyethyl)amino]-aniline (D-5) and 4-amino-3-methyl-N-ethyl-N-[8-(methanesulfonamido) ethyl]aniline (D-6).

These p-phenylenediamine derivatives may be in the form of their salts, such as sulfates, hydrochlorides, sulfites or p-toluenesulfonates. The compounds may be used in combination of two or more in accordance with the desired object. For example, (D-5) and (D-6) may be used in combination. The amount of the aromatic primary amine developing agent is preferably from approximately 0.5 g to 30 g, more preferably from approximately 1.0 g to 20 g, per liter of developer.

In carrying out the present invention, a developer substantially not containing benzyl alcohol is preferably used. The phrase "substantially not containing benzyl alcohol" as used to herein means that the benzyl alcohol content in the developer is preferably 2 ml/liter or less, more preferably 0.5 ml/liter or less, and most preferably, the developer contains no benzyl alcohol.

The developer used in the present invention preferably is substantially free from sulfite ions. A sulfite ion functions as a preservative for developing agents and additionally has a silver halide-dissolving action and an action of lowering the dye-forming efficiency by reacting with the oxidation product of developing agents. Such function and actions of sulfite ion are considered to aggravate fluctuation of photographic properties of photographic materials processed by a continuous processing procedure. The phrase "substantially free from sulfite ions" means that the sulfite ion concentration . in the developer is preferably $3.0 \times 10^{-3}$ mol/liter or less, and most preferably the developer contains no sulfite ion. However, the developer may contain an extremely small amount of sulfite ion employed an antioxidant for the processing liquid kit containing a concentrated developing agent prior to preparation of a developer for use.

The developer for use in the present invention is preferred to be substantially free from sulfite ions, and is more preferred to be also substantially free from hydroxylamine. This is because hydroxylamine functions as a preservative for the developer and also has an action of activating development of silver by itself so that the fluctuation of the concentration of hydroxylamine in the developer to be used would have a noticeable influence on the photographic characteristics of the photographic materials processed. The phrase "substantially free from hydroxylamine" means that the hydroxylamine concentration in the developer is preferably $5.0 \times 10^{-3}$ mol/liter or less, and most preferably the developer contains no hydroxylamine.

Preferably, the developer to be used in the present invention contains an organic preservative in place of the above-mentioned hydroxylamine and sulfite ion.

The organic preservative which may be used in the developer in the present invention may be any organic compound which retards the deterioration speed of aromatic primary amine color developing agents by adding into processing solutions for color photographic materials. That is, useful organic preservatives include organic compounds having a function of preventing aerial oxidation of color developing agents. Hydroxylamine derivatives (excepting hydroxylamine—the same hereunder), hydroxamic acids, hydrazines, hydrazides, phenols, alpha-hydroxyketones, alpha-aminoketones, saccharides, monoamines, diamines, polyamines, quaternary ammonium salts, nitroxy radicals, alcohols, oximes, diamide compounds and condensed cyclic amines, are especially effective organic preservatives. These compounds are illustrated in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-52-143020, and JP-B-48-30496.

In addition, various metal compounds described in JP-A-57-44148 and JP-A-57-53749; salicylic acid derivatives described in JP-A-59-180588; alkanolamines described in JP-A-54-3532; polyethyleneimines described in JP-A-56-94349; and aromatic polyhydroxy compounds described in U.S. Pat. Nos. 3,746,544 may also be added to the developer as a preservative. In particular, addition of alkanolamines such as triethanolamine, dialkylhydroxylamines such as diethylhydroxylamine, as well as hydrazine derivatives of aromatic polyhydroxy compounds, are preferred.

Among the above-mentioned organic preservatives, hydroxylamine derivatives and hydrazine derivatives (hydrazines or hydrazides) are especially preferred, and the details thereof are described in JP-A-1-97953, JP-A-186939, JP-A-1-186940 and JP-A-1-187557.

Combination of the above-mentioned hydroxylamine derivatives or hydrazine derivatives and amines is preferred from the viewpoint of improving the stability of the color developer and of further improving the stability of photographic materials upon continuous processing with the developer.

Suitable amines which may be combined with the above-mentioned derivatives include cyclic amines described in JP-A-63-239447, amines described in JP-A-3-128340 and amines described in JP-A-1-186939 and JP-A-1-187557.

The color developer used in the method of the present invention preferably contains chloride ion in an amount of from $3.5\times10^{-2}$ to $1.5\times10^{-1}$ mol/liter, especially preferably from $4\times10^{-2}$ to $1\times10^{-1}$ mol/liter. If the chloride ion concentration in the color developer is more than $1.5\times10^{-1}$ mol/liter, the developer might retard development. Such would be unfavorable in view of the object of the present invention of effecting high-speed development to give an image having a high maximum density. On the other hand, if the chloride ion concentration is less than $3.5\times10^{-2}$ mol/liter, the developer may have unfavorable anti-fogging properties.

The color developer for use in the present invention preferably contains bromide ion in an amount of from $3.0\times10^{-5}$ mol/liter to $1.0\times10^{-3}$ mol/liter, more preferably from $5.0\times10^{-5}$ to $5\times10^{-4}$ mol/liter. If the bromide ion concentration in the developer is more than $1\times10^{-3}$ mol/liter, the development may be retarded and the maximum density and the sensitivity may be lowered. On the other hand, if it is less than $3.0\times10^{-5}$ mol/liter, the developer might not sufficiently inhibit fogging.

The chloride ion and bromide ion may be directly added to the developer, or may be dissolved out into the developer from photographic materials being processed.

In the former case where the ions are directly added to the color developer, sodium chloride, potassium chloride, ammonium chloride, lithium chloride, nickel chloride, magnesium chloride, manganese chloride, calcium chloride and cadmium chloride may be used as a chloride ion-donating substance. Among them, sodium chloride and potassium chloride are preferred.

Such ions may be derived from the brightening agent added to the developer.

Bromide ion-donating substances include sodium bromide, potassium bromide, ammonium bromide, lithium bromide, calcium bromide, magnesium bromide, manganese bromide, nickel bromide, cadmium bromide, cerium bromide and thallium bromide. Among them, potassium bromide and sodium bromide are preferred.

In the latter case where the ions are derived from photographic materials being processed, both the chloride ion and the bromide ion may be derived from either the emulsion layers of the materials or any layer other than the emulsion layers.

The color developer for use in the present invention preferably has a pH value falling within the range of from 9 to 12, more preferably from 9 to 11.0.

In order to maintain the above-mentioned pH range, the color developer preferably contains various buffers. Buffers which may be added to the developer include carbonates, phosphates, borates, tetraborates, hydroxybenzoates, glycine salts, N,N-dimethylglycine salts, leucine salts, norleucine salts, guanine salts, 3,4-dihydroxylphenylalanin salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are preferred, as having an excellent solubility and an excellent buffering property even in a high range of pH 9.0 or more. More advantageously, they give no adverse influences (for example, fogging) on the photographic properties of the photographic materials to be processed, even when added to a color developer. Moreover, they are inexpensive. Therefore, these buffers are especially preferably employed.

Specific examples of the preferred buffers include sodium carbonate, potassium carbonate, sodium bisulfite, potassium bisulfite, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, these compounds are not limitative.

The amount of the above-mentioned buffer to be added to the color developer for use in the present invention is preferably 0.1 mol/liter or more, especially preferably from 0.1 mol/liter to 0.4 mol/liter.

Additionally, the color developer for use in the present invention may contain various chelating agents as a precipitation-inhibitor for calcium or magnesium or for the purpose of improving the stability of the color developer. For instance, suitable chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycolether-dimine-tetraacetic acid, ethylenediamineorthohydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid.

These chelating agents may be employed as a combination of two or more, if desired.

The amount of the chelating agent to be added to the color developer may be that amount which is sufficient to sequester the metal ions in the color developer. For example, the amount may be from approximately 0.1 g to 10 g/liter.

The color developer for use in the present invention may optionally contain any desired development accelerator.

Examples of development accelerators which may be added to the color developer include thioether compounds described in JP-B-37-16088, JP-B-37-5987, JP-B-38-7826, JP-B-44-12380, JP-B-45-9019, U.S. Pat. No. 3,813,247; p-phenylenediamine compounds described in JP-A-52-49829, JP-A-50-15554; quaternary ammonium salts described in JP-A-50-137726, JP-B-44-30074, JP-A-5656826, JP-A-52-43429; amine compounds described in U.S. Pat. Nos. 2,494,903, 3,128,182, 4,230,796, 3,253,919, JP-B-41-11431, U.S. Pat. Nos. 2,482,546, 2,596,962, 3,582,346; polyalkylene oxides described in JP-B-376088, JP-B-42-25201, U.S. Pat. No. 3,128,183, JP-B-411431, JP-B-42-23883, U.S. Pat. No. 3,532,501; as well as other 1-phenyl-3-pyrazolidones and imidazoles.

The color developer for use in the present invention may further contain, if desired, various antifoggants. More particularly, an alkali metal halide such as sodium chloride or potassium chloride, or an organic antifoggant may be added to the color developer in an amount that would not .cause retardation of development. Suitable organic antifoggants include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolidine and adenine.

The color developer used in the present invention preferably contains a brightening agent. Preferred brightening agents are 4,4'-diamino-2,2'-disulfostilbene compounds. The amount of the agent to be added is up to 5 g/liter, preferably from 0.1 to 4 g/liter.

If desired, the color developer for use in the present invention may contain various surfactants such as alkylsulfonic acids, arylsulfonic acids, aliphatic carboxylic acids or aromatic carboxylic acids.

The color developer may further contain conventional developer components within the purposes of the present invention.

The processing temperature for processing the photographic materials of the present invention with the above-described color developer is from 30° C. to 50° C., preferably from 35° C. to 50° C. The processing time is from 5 seconds to 20 seconds, preferably from 5 seconds to 15 seconds. The amount of the replenisher to the developer is preferably as small as possible. Suitably, it is from 20 to 600 ml, more preferably from 30 to 100 ml, per $m^2$ of the photographic material being processed.

When the amount of the replenisher to be added is relatively low, it is desired to prevent the evaporation and aerial oxidation of the processing solution by reducing the contact surface area of the processing tank with air. The contact surface area of the processing solution with air in the processing tank is represented by the "opening ratio", which is defined by the following formula:

$$\text{Opening Ratio} = \frac{\text{Contact Surface Area (cm}^2\text{) of Processing Solution with Air}}{\text{Volume (cm}^3\text{) of Processing Tank}}$$

The above-mentioned opening ratio is preferably 0.1 or less, more preferably from 0.001 to 0.05.

Various means can be employed for the purpose of reducing the opening ratio, which include, for example, provision of a masking substance such as a floating lid on the surface of the processing solution in the processing tank, use of the mobile lid described in Japanese Patent Application No. 62-241342 and employment of the slit-developing method described in JP-A-63-216050.

Reduction of the opening ratio is preferably applied to not only both steps of color development and black-and-white development but also to all the subsequent steps such as bleaching, bleach-fixation, fixation, rinsing and stabilization steps.

In addition, the amount of the replenisher to be added may also be reduced by means of suppressing accumulation of bromide ions and iodide ions in the developer.

Next, the desilvering step to be applied to the method of the present invention will be explained below. Desilvering may be effected by any procedure comprising any one of bleaching step/fixation step; fixation step/bleach-fixation step; bleaching step/bleach-fixation step; and bleach-fixation step.

The bleaching or bleach-fixation step may be defined to fall within the range of from 10 seconds to 45 seconds, at a temperature of from 30° C. to 50° C.

The bleaching solution, bleach-fixing solution and fixing solution applicable to the present invention are described.

Any bleaching agent can be employed in the bleaching solution or bleach-fixing solution used in the present invention. In particular, organic complexes of iron(III) (for example, complexes with aminopolycarboxylic acids such as ethylenediaminetetraacetic acid or diethylenetriaminepentaacetic acid, or aminopolyphosphyonic acids, phosphonocarboxylic acids or organic phosphonic acids) or organic acids such as citric acid, tartaric acid or malic acid; persulfates; and hydrogen peroxide are preferred.

Among them, organic complexes of iron(III) are especially preferred in view of the rapid processability thereof and the prevention of environmental pollution. Examples of aminopolycarboxylic acids, aminopolyphosphonic acids or organic phosphonic acids as well as salts thereof include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycoletherdiaminetetraacetic acid. These compounds may be in any form of sodium, potassium, lithium or ammonium salts. Among these compounds, iron(III) complexes of ethylenediaminetetraacetic acid, diethylenetriaminepentaacetic acid, cyclohexanediaminetetraacetic acid, 1,3-diaminopropanetetraacetic acid and methyliminodiacetic acid are preferred as having a high bleaching power. The ferric ion complexes may be employed as such, or a ferric salt such as ferric chloride, ferric sulfate, ferric nitrate, ammonium ferric sulfate or ferric phosphate and a chelating agent such as an aminopolycarboxylic acid, aminopolyphosphonic acid or phosphonocarboxylic acid may be added to the processing solution to form a ferric ion complex in the solution. In the latter case, the chelating agent may be used excessively to formation of the ferric complex. Among these complexes, iron complexes of aminopolycarboxylic acids are preferred, and the amount of such complexes to be added may be from 0.01 to 1.0 mol/liter, preferably from 0.05 to 0.50 mol/liter.

Various compounds may be added to the bleaching solution, bleach-fixing solution and/or prebath thereof, as a bleaching accelerator. For example, mercapto group- or disulfido bond-having compounds described in U.S. Pat. No. 3,893,858, West German Patent 1,290,812, JP-A-53-95630, Research Disclosure, Item No. 17129 (July, 1978); thiourea compounds described in JP-B-45-8506, JP-A-52-20832, JP-A-53-32735, U.S. Pat. No. 3,706,561; as well as halides such as bromide or iodide ions are preferred, as having an excellent bleaching power.

Additionally, the bleaching solution or bleach-fixing solution employable in the present invention may further contain a re-halogenating agent such as bromides (e.g., potassium bromide, sodium bromide, ammonium bromide), chlorides (e.g., potassium chloride, sodium chloride, ammonium chloride) or iodides (e.g., ammonium iodide). If desired, the solution may also contain one or more inorganic or organic acids or alkali metal or ammonium salts thereof having a pH-buffering capacity, such as borax, sodium metaborate, acetic acid, sodium acetate, sodium carbonate, potassium carbonate, phosphorous acid, phosphoric acid, sodium phosphate, citric acid, sodium citrate or tartaric acid, as well as a corrosion-inhibitor such as ammonium nitrate or guanidine.

The bleach-fixing solution or fixing solution for use in the present invention may contain any known fixing agent. For example, the fixing agent may be a water-soluble silver halide-solubilizing agent, including thiosulfates such as sodium thiosulfate or ammonium thiosulfate; thiocyanates such as sodium thiocyanate or ammonium thiocyanate; thioether compounds such as ethylenebisthioglycolic acid or 3,6-dithia-1,8-octanediol; and thioureas. One or more of these compounds may be added to the solution as a fixing agent. Additionally, a particular bleach-fixing solution containing a fixing agent and a large amount of a halide such as potassium iodide, as described in JP-A-55-155354, may also be used in the present invention. In the present invention, employment of thiosulfates especially ammonium thiosulfate, is preferred. The amount of the fixing agent per liter of the solution is preferably from 0.3 to 2 mols, more preferably from 0.5 to 1.0 mol. The pH range of the bleach-fixing solution or fixing solution is preferably from 3 to 10, more preferably from 5 to 9.

The bleach-fixing solution may further contain other various brightening agents, defoaming agents or surfactants, polyvinyl pyrrolidone or various organic solvents such as methanol.

The bleach-fixing solution or fixing solution for use in the present invention preferably contains, as a preservative, a sulfite ion-releasing compound, for example, sulfites such as sodium sulfite, potassium sulfite or ammonium sulfite, bisulfites such as ammonium bisulfite, sodium bisulfite or potassium bisulfite, or metabisulfites such as potassium metabisulfite, sodium metabisulfite or ammonium metabisulfite. The content of the preservative compound is preferably from approximately 0.02 to 0.05 mol/liter, more preferably from 0.04 to 0.40 mol/liter, as sulfite ion.

Although sulfites is generally be added as a preservative to the solution, ascorbic acid, carbonylbisulfite adducts or carbonyl compounds may also be added.

Additionally, a buffer, a fluorescent brightening agent, a chelating agent, a defoaming agent or a fungicide may be added to the bleach-fixing solution or bleaching solution for use in the present invention, if desired.

After being desilvered by fixation or bleach-fixation, the photographic material of the present invention is generally rinsed with water and/or stabilized.

The amount of the water to be used in the rinsing step can be set within a broad range, in accordance with the characteristics of the photographic material being processed (for example, depending upon the raw material components, such as the coupler and so on) or the use of the material, as well as the temperature of the rinsing water, the number of the rinsing tanks (the number of the rinsing stages), the replenishment system (normal current or countercurrent) and other various kinds of conditions. Among these conditions, the relation between the number of the rinsing tanks and the amount of the rinsing water in a multi-stage countercurrent rinsing system can be obtained by the method described in *Journal of the Society of Motion Picture and Television Engineers*, Vol. 64, pages 248 to 253 (May, 1955). In general, the number of stages in multi-stage countercurrent system is preferably from 2 to 6, especially preferably from 2 to 4.

According to the multi-stage countercurrent system, the amount of the rinsing water to be used can be reduced noticeably. For example, the amount thereof may be from 0.5 liter to one liter or less per $m^2$ of the photographic material to be processed, and the effect attainable by the present invention is noticeable under such conditions. However, because of the prolongation of the residence time of the water in the rinsing tank, bacteria would propagate in the tank so that the floating substances generated by the propagation of bacteria might adhere to the surface of the material as it is processed. Accordingly, the system would often have a problem. In the practice of processing the photographic materials of the present invention, the method of reducing calcium and magnesium ions, which is described in JP-A-62-288838, can extremely effectively be used for overcoming this problem. In addition, isothiazolone compounds and thiabendazoles described in JP-A-57-8542; chlorine-containing bactericides such as chlorinated sodium isocuanulates, as described in JP-A-61-120145; benzotriazoles and copper ions described in JP-A-61-267761; and other bactericides described in H. Horiguchi, *Chemistry of Bactericidal and Fungicidal Agents* (1986, by Sankyo Publishing Co.), *Bactericidal*

*and Fungicidal Techniques to Microorganisms*, edited by Association of Sanitary Technique, Japan (1982, Industrial and Technical Association), and *Encyclopedia of Bactericidal and Fungicidal Agents*, edited by Nippon Bactericide and Fungicide Association (1988), can also be used.

Additionally, the rinsing water may further contain a surfactant as a water drainer as well as a chelating agent such as EDTA as a water softener.

Following the above-mentioned rinsing step or without the same, the photographic material of the present invention may be processed with a stabilizing solution. The stabilizing solution contains a compound having an image-stabilizing function. For example, the solution contains an aldehyde compound such as formalin, or a buffer for adjusting the film pH to that suitable for stabilization of the dyes formed, as well as an ammonium compound. In addition, the solution may also contain the above-mentioned various bactericides and fungicides for the purpose of preventing propagation of bacteria in the solution and of imparting a fungicidal property to the processed photographic material.

Further, the stabilizing solution may also contain a surfactant, a fluorescent brightening agent and a hardening agent. In the method of processing the photographic material by the present invention, if the stabilization is directly effected without the previous rinsing step, known means, such as described in JP-A-57-8543, JP-A-58-14834 and JP-A-60-220345 can be employed.

Additionally, employment of chelating agents such as 1-hydroxyethylidene-1,1-diphosphonic acid or ethylenediaminetetramethylenephosphonic acid, as well as magnesium or bismuth compounds, is preferred.

A so-called rinsing solution may also be employed as the water or stabilizing solution used in the water-rinsing or stabilizing step to be effected after the desilvering step.

The pH value in the rinsing step or stabilizing step is preferably from 4 to 10, more preferably from 5 to 8. The temperature in this step may variously be defined in accordance with the characteristics and uses of the photographic materials being processed. In general, it is from 15° to 45° C,. preferably from 20 to 40° C. The processing time may also be defined relatively freely. However, it is preferably shorter from the viewpoint of reducing the processing time. Preferably, the time is from 15 seconds to 1 minute and 45 seconds, more preferably from 30 seconds to 1 minute and 30 seconds. The amount of the replenisher used in this step is preferably smaller from the viewpoint of reducing the running cost, reducing the amount of waste to be drained and improving the operability of the process.

As one preferred embodiment for replenishment, the amount of the replenisher is from 0.5 to 50 times, more preferably from 3 to 40 times, of the amount of the carryover from the previous bath per the unit area of the photographic material being processed. That is, it is one liter or less, preferably 500 ml or less, per $m^2$ of the photographic material. Replenishment may be effected either continuously or intermittently.

The solution used in the rinsing and/or stabilization steps may further be used in the previous step. As one example of such a system, the overflow of the rinsing solution as reduced by employing a multi-stage countercurrent system, may be returned back to the previous bleach-fixing bath, while a concentrated processing solution is replenished to the bleach-fixing bath. Accordingly, the amount of the waste liquid to be drained from the process may be reduced.

The silver halide color photographic materials of the present invention can contain a color developing agent for the purpose of simplifying and accelerating the processing of the materials. For incorporation of color developing agents into the photographic materials, various precursors of the agents are preferably used. For example, indoaniline compounds described in U.S. Pat. No. 3,342,597, Schiff base compounds described in U.S. Pat. No. 3,342,599 and Research Disclosure Item 14850 and 15159, aldole compounds described in *Research Disclosure* Item 13924, metal complexes described in U.S. Pat. No. 3,719,492 and urethane compounds described in JP-A-53-135628, may be used as the precursors.

The silver halide color photographic materials of the present invention can contain various kinds of 1-phenyl-3-pyrazolidones, if desired, for the purpose of accelerating the color developability thereof. Specific examples of these compounds are described in JP-A-5664339, JP-A-57-144547, and JP-A-58-115438.

For the purpose of economization of silver in the photographic materials to be processed by the present invention, cobalt intensification or hydrogen peroxide intensification described in West German Patent 2,226,770 and U.S. Pat. No. 3,674,499 may be employed in processing the materials by the method of the present invention.

Next, the present invention will be explained in more detail by way of the following Examples, which, however, are not intended to restrict the scope of the present invention in any manner.

EXAMPLE 1

Preparation of Silver Halide Emulsions (A-1) to (A-7)

25 g of lime-processed gelatin was added to 800 ml of distilled water and dissolved at 40° C., and the pH value of the resulting solution was adjusted to be 3.8 with sulfuric acid. 1.7 g of sodium chloride and 0.01 g of N,N'-dimethylethylenethiourea were dissolved into the resulting solution to give Aqueous Solution (I). Next, 125 g of silver nitrate was dissolved in 500 ml of distilled water to give Aqueous Solution (II). Additionally, 43 g of sodium chloride, 0.3 mg of yellow prussiate of potash (potassium ferrocyanide) and 0.01 mg of dipotassium iridium hexachloride were dissolved in 500 ml of distilled water to give Aqueous Solution (III). Aqueous Solution (II) and Aqueous Solution (III) were simultaneously added to Aqueous Solution (I) as warmed at 45° C. over a period of 45 minutes and mixed. Excess salts were removed from the thus obtained silver halide grains-containing dispersion by a flocculation method, and 50 g of lime-processed gelatin was added to the residue for re-dispersion. Spectral-sensitizing Dye (V-1) mentioned below was added to the resulting dispersion in an amount of $6.0\times10^{-4}$ mol per mol of silver halide for spectral-sensitization. Next, the thus spectrally-sensitized dispersion was further sulfur-sensitized with N,N,N'-triethylthiourea, forming silver bromide on the already formed silver chloride grains by halogen-conversion.

(V-1)

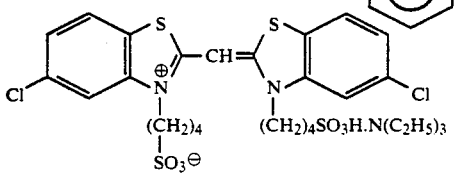

Accordingly, Silver Chlorobromide Emulsion (A-1) having a mean grain size of 0.50 micron, a fluctuation coefficient of 0.07 and a silver chloride content of 99.6 mol % was obtained, the grains in the emulsion being cubic.

In the same manner as mentioned above, other Emulsions (A-2) to (A-7) mentioned in Table 1 below were prepared. For controlling the mean grain size and the silver chloride content of the silver halide grains in each emulsion as indicated in Table 1, the concentration of each of Aqueous Solutions (I), (II) and (III), the time for adding the solutions, the temperature in the step of adding the same, the stirring means in the adding step, the pBr value in the mixing container in the mixing step and the degree of halogen-conversion were appropriately varied, in preparing Emulsions (A-2) to (A-7).

TABLE 1

| | Blue-Sensitive Silver Halide Emulsions | | |
|---|---|---|---|
| | Mean Grain Size (micron) | Fluctuation Coefficient | AgCl Content (mol %) |
| A-1 | 0.50 | 0.07 | 99.6 |
| A-2 | 0.40 | 0.07 | 99.6 |
| A-3 | 0.72 | 0.09 | 99.6 |
| A-4 | 0.83 | 0.10 | 99.6 |
| A-5 | 0.51 | 0.07 | 99.2 |
| A-6 | 0.51 | 0.08 | 92.0 |
| A-7 | 0.50 | 0.11 | 65.0 |

Preparation of Silver Halide Emulsions (B-1) to (B-6)

Silver Halide Emulsions (B-1) to (B-6) as shown in Table 2 below were prepared in the same manner as mentioned above, except that the following Color-Sensitizing Dyes (V-2) and (V-3) were employed in an amount of $4.5\times10^{-4}$ mol and $9.5\times10^{-5}$ mol, respectively, in place of Spectrally-Sensitizing Dye (V-1) employed in preparing Emulsion (A-1).

(V-2)

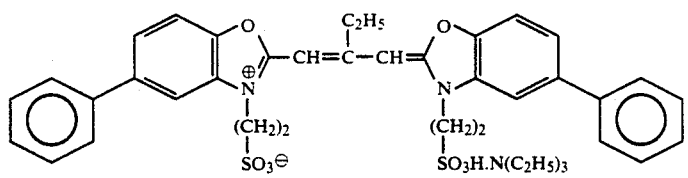

(V-3)

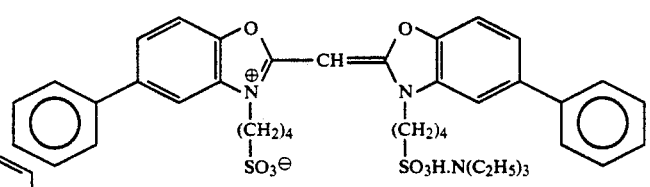

TABLE 2

| | Green-Sensitive Silver Halide Emulsions | | |
|---|---|---|---|
| | Mean Grain Size (micron) | Fluctuation Coefficient | AgCl Content (mol %) |
| B-1 | 0.45 | 0.07 | 99.2 |
| B-2 | 0.49 | 0.07 | 99.2 |
| B-3 | 0.41 | 0.06 | 99.2 |
| B-4 | 0.61 | 0.08 | 99.2 |
| B-5 | 0.49 | 0.07 | 98.8 |
| B-6 | 0.50 | 0.07 | 93.0 |

Preparation of Silver Halide Emulsions (C-1) to (C-6)

Silver Halide Emulsions (C-1) to (C-6) as shown in Table 3 below were prepared in the same manner as mentioned above, except that the following Spectrally-Sensitizing Dye (V-4) was employed in an amount of $9.0\times10^{-5}$ mol per mol of silver halide in place of Spectrally-Sensitizing Dye (V-1) employed in preparing Emulsion (A-1).

(V-4)

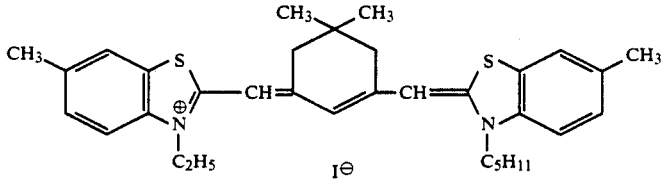

TABLE 3

| | Red-Sensitive Silver Halide Emulsions | | |
|---|---|---|---|
| | Mean Grain Size (micron) | Fluctuation Coefficient | AgCl Content (mol %) |
| C-1 | 0.42 | 0.06 | 99.2 |
| C-2 | 0.51 | 0.07 | 99.2 |
| C-3 | 0.55 | 0.07 | 99.2 |
| C-4 | 0.65 | 0.08 | 99.2 |
| C-5 | 0.50 | 0.07 | 98.5 |
| C-6 | 0.49 | 0.07 | 91.5 |

Preparation of Photographic Materials (Sample Nos. 10 to 23)

A multi-layered color photographic paper (Sample No. 10) was prepared by coating plural layers mentioned below on a polyethylene-laminated paper support. Coating compositions used were prepared as mentioned below.

Preparation of First Layer-Coating Composition 27.2 ml of ethyl acetate and 8.2 g of Solvent (Solv-3) were added to 19.1 g of Yellow Coupler (ExY), 4.4 g of Color Image Stabilizer (Cpd-1) and 0.7 g of Color Image Stabilizer (Cpd-7) and dissolved, and the resulting solution was emulsified and dispersed in 185 ml of 10% aqueous gelatin solution containing 8 ml of 10% sodium dodecylbenzensulfonate.

The emulsified dispersion and the above-mentioned Emulsion (A-1) were mixed and dissolved to obtain a first layer-coating composition having the components mentioned below.

The other second layer-coating to seventh layer-coating compositions were also prepared in the same manner as mentioned above. The gelatin-hardening agent used for each layer was 1-hydroxy-3,5-dichloro-striazine sodium salt.

To the red-sensitive emulsion layer was added the following compound in an amount of $2.6\times10^{-3}$ mol per mol of silver halide:

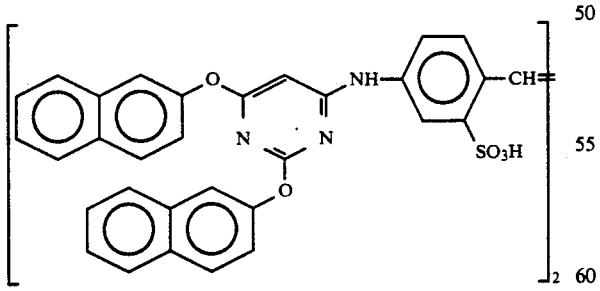

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, respectively.

For anti-irradiation, the following dyes were added to the emulsion layers.

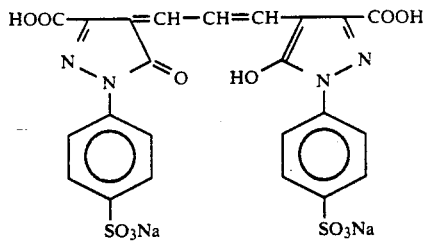

and

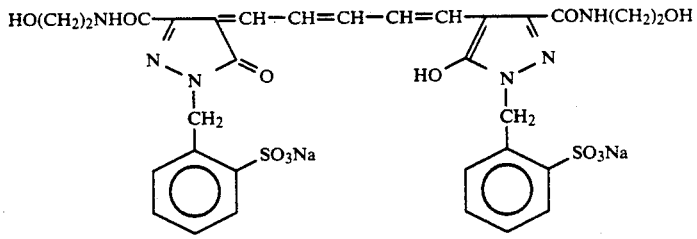

Layer Constitution

Composition of each layer is shown below. The number for each component indicates the amount coated ($g/m^2$). The amount of silver halide emulsion coated is represented by the amount of silver therein.

Support

Polyethylene-Laminated Paper (containing white pigment ($TiO_2$) and bluish dye (ultramarine) in polyethylene below the first layer)

| | |
|---|---|
| First Layer: Blue-Sensitive Layer | |
| Emulsion (A-1) | 0.30 |
| Gelatin | 1.10 |
| Yellow coupler (ExY) | 0.82 |
| Color image stabilizer (Cpd-1) | 0.19 |
| Solvent (Solv-3) | 0.35 |
| Color image stabilizer (Cpd-7) | 0.06 |
| Second Layer: Color Mixing Preventing Layer | |
| Gelatin | 0.59 |
| Color mixing preventing agent (Cpd-5) | 0.08 |
| Solvent (Solv-1) | 0.16 |
| Solvent (Solv-4) | 0.08 |
| Third Layer: Green-Sensitive Layer | |
| Emulsion (B-1) | 0.12 |
| Gelatin | 1.07 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| First Layer: Ultraviolet-Absorbing Layer | |
| Gelatin | 0.95 |
| Ultraviolet absorbent (UV-1) | 0.47 |
| Color mixing preventing agent (Cpd-5) | 0.05 |
| Solvent (Solv-5) | 0.24 |
| Fifth Layer: Red-Sensitive Layer | |
| Emulsion (C-1) | 0.23 |
| Gelatin | 0.80 |
| Cyan coupler (ExC) | 0.32 |
| Color image stabilizer (Cpd-6) | 0.17 |
| Color image stabilizer (Cpd-7) | 0.40 |
| Color image stabilizer (Cpd-8) | 0.04 |
| Solvent (Solv-6) | 0.15 |
| Sixth Layer: Ultraviolet-Absorbing Layer | |
| Gelatin | 0.32 |

-continued
| | |
|---|---|
| Ultraviolet absorbent (UV-1) | 0.16 |
| Color mixing preventing agent (Cpd-5) | 0.02 |
| Solvent (Solv-5) | 0.08 |
| Seventh Layer: Protective Layer | |
| Gelatin | 1.06 |
| Acryl-modified copolymer of polyvinyl alcohol (modification degree: 17%) | 0.17 |
| Liquid paraffin | 0.03 |
Compounds used above are as follows
Yellow Coupler (ExY):
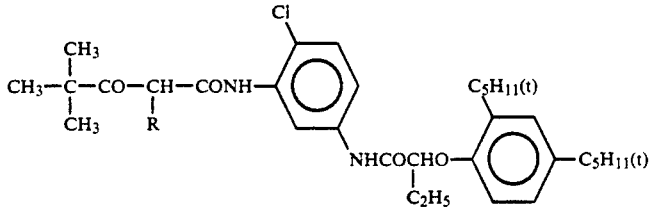
(1/1, by mol) mixture of
R =
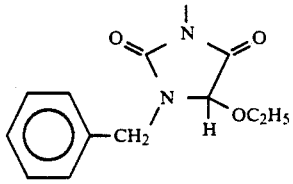
and
R =
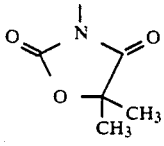
Magenta Coupler (ExM):
(1/1, by mol) mixture of
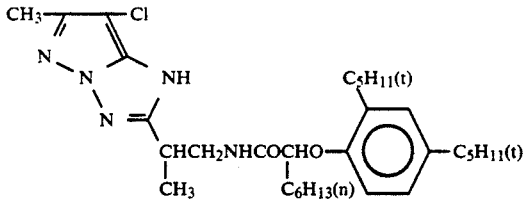
and
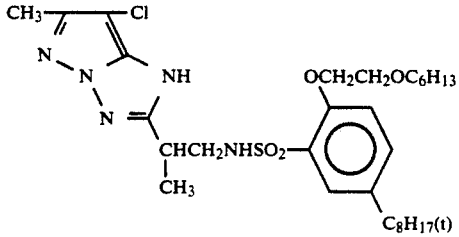
Cyan Coupler (ExC):

-continued
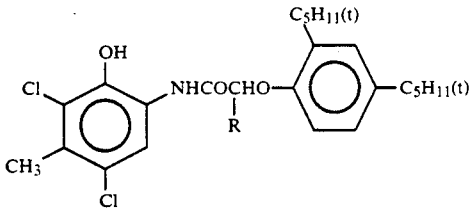
(2/4/4, by weight) mixture of
R = $C_2H_5$, R = $C_4H_9$, and
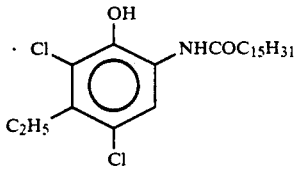
Color Image Stabilizer (Cpd-1):
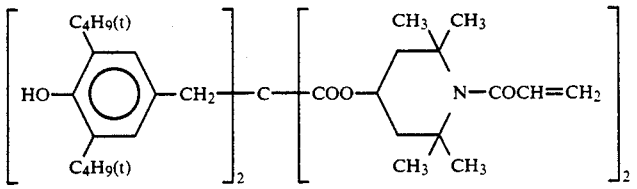
Color Image Stabilizer (Cpd-2):
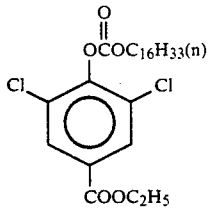
Color Image Stabilizer (Cpd-3):
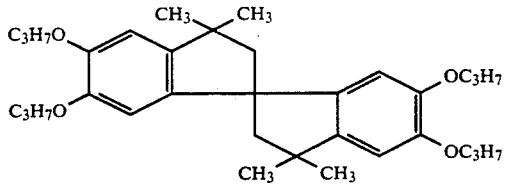
Color Image Stabilizer (Cpd-4):
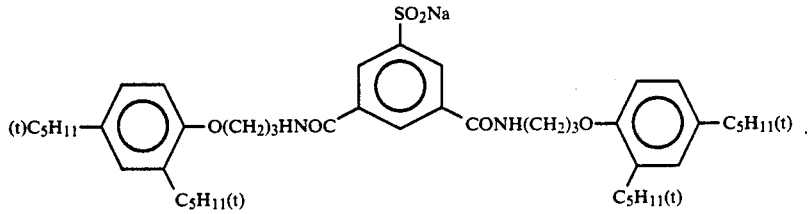
Color Mixing Preventing Agent (Cpd-5):

-continued
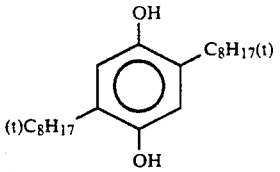
Color Image Stabilizer (Cpd-6):
(2/4/4, by weight) mixture of
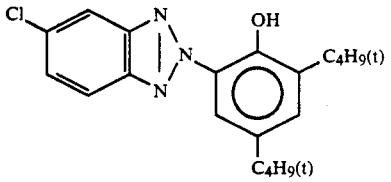
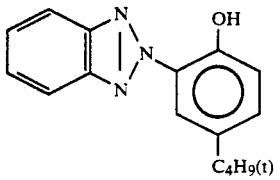
and
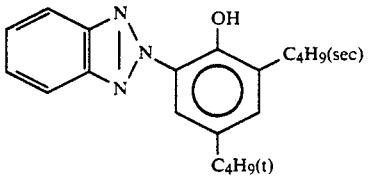
Color Image Stabilizer (Cpd-7):
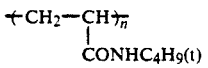
(mean molecular weight 60,000)
Color Image Stabilizer (Cpd-8):
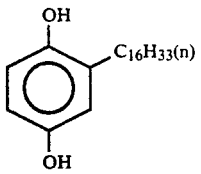
Color Image Stabilizer (Cpd-9):
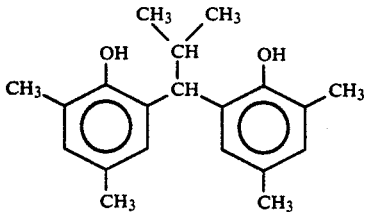
Ultraviolet Absorbent (UV-1):
(4/2/4, by weight) mixture of -continued
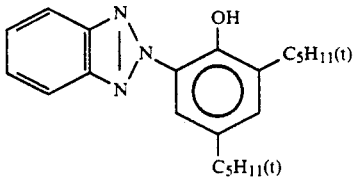
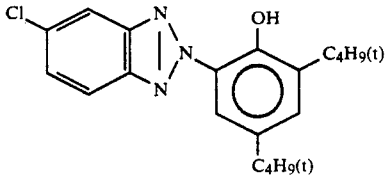
and
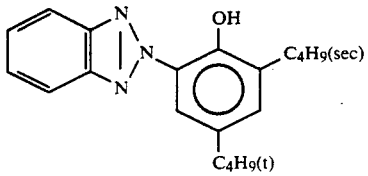
Solvent (Solv-1):
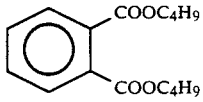
Solvent (Solv-2):
(2/1, by volume) mixture of
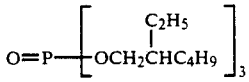
and
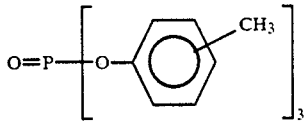
Solvent (Solv-3):
$O{=}P{+}O{-}C_9H_{19}(iso)]_3$
Solvent (Solv-4):
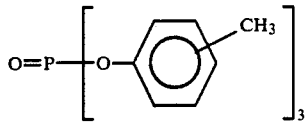
Solvent (Solv-5):
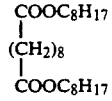
Solvent (Solv-6):

-continued

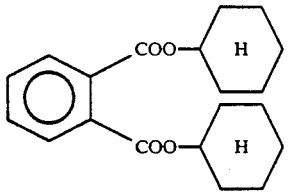

Accordingly, a photographic material sample (Sample No. 10) was prepared. In the same manner as mentioned above, other photographic material samples (Samples Nos. 11 to 23) as shown in Tables 4 and 5 below were prepared, selecting and combining Emulsions (A-2) to (A-7) in Table 1, Emulsions (B-2) to (B-6) in Table 2 and Emulsions (C-2) to (C-6) in Table 3.

TABLE 4

| | Photographic Material Sample Nos. 10 to 16 | | | | |
|---|---|---|---|---|---|
| | Mean Grain Size of Silver Halide Grains (μm) | | | | |
| Sample No. | Blue-Sensitive Layer | Green-Sensitive Layer | Red-Sensitive Layer | Maximum Ratio of Grain Size | |
| 10 | 0.50 Emulsion (A-1) | 0.45 Emulsion (B-1) | 0.42 Emulsion (C-1) | (1.19) | Example of the Invention |
| 11 | 0.50 Emulsion (A-1) | 0.49 Emulsion (B-2) | 0.51 Emulsion (C-2) | (1.04) | " |
| 12 | 0.50 Emulsion (A-1) | 0.49 Emulsion (B-2) | 0.55 Emulsion (C-3) | (1.12) | " |
| 13 | 0.40 Emulsion (A-2) | 0.41 Emulsion (B-3) | 0.51 Emulsion (C-2) | (1.27) | " |
| 14 | 0.72 Emulsion (A-3) | 0.61 Emulsion (B-4) | 0.65 Emulsion (C-4) | (1.18) | " |
| 15 | 0.72 Emulsion (A-3) | 0.49 Emulsion (B-2) | 0.51 Emulsion (C-2) | (1.47) | Comparative Example |
| 16 | 0.83 Emulsion (A-4) | 0.61 Emulsion (B-4) | 0.65 Emulsion (C-4) | (1.36) | " |

TABLE 5

| | Photographic Material Sample Nos. 20 to 23 | | | | |
|---|---|---|---|---|---|
| | Mean AgCl Content in Silver Bromochloride Grains | | | | |
| Sample No. | Blue-Sensitive Layer | Green-Sensitive Layer | Red-Sensitive Layer | Maximum Ratio of Grain Size | |
| 11 | 99.6 mol % 0.50 μm Emulsion (A-1) | 99.2 mol % 0.49 μm Emulsion (B-2) | 99.2 mol % 0.51 μm Emulsion (C-2) | 1.04 | Example of the Invention |
| 20 | 99.2 mol % 0.51 μm Emulsion (A-5) | 98.8 mol % 0.49 μm Emulsion (B-5) | 98.5 mol % 0.50 μm Emulsion (C-5) | 1.04 | " |
| 21 | 99.2 mol % 0.51 μm Emulsion (A-5) | 99.2 mol % 0.49 μm Emulsion (B-2) | 98.5 mol % 0.50 μm Emulsion (C-5) | 1.04 | " |
| 22 | 92.0 mol % 0.51 μm Emulsion (A-6) | 98.8 mol % 0.49 μm Emulsion (B-5) | 98.5 mol % 0.50 μm Emulsion (C-5) | 1.04 | Comparative Example |
| 23 | 65.0 mol % 0.50 μm Emulsion (A-7) | 93.0 mol % 0.50 μm Emulsion (B-6) | 91.5 mol % 0.49 μm Emulsion (C-6) | 1.02 | " |

Evaluation of Photographic Material Samples

Each sample was wedgewise exposed through a sensitiometrical three-color separating filter by the use of a sensitometer (FWH Type, manufactured by Fuji Photo Film Co., Ltc.; color temperature of light source 3200° K.), whereupon exposure was effected for an exposing time of 0.1 second with an exposure amount of 250 CMS. The thus exposed sample was then developed in accordance with the following development process (I) or (II).

| Processing Steps | Process (I) | Process (II) |
|---|---|---|
| Color Development | 35° C., 45 sec | 48° C., 15 sec |
| Bleaching | 35° C., 30 sec | 35° C., 30 sec |
| Rinsing (1) | 35° C., 20 sec | 35° C., 20 sec |
| Rinsing (2) | 35° C., 20 sec | 35° C., 20 sec |
| Rinsing (3) | 35° C., 20 sec | 35° C., 20 sec |
| Drying | 80° C., 30 sec | 80° C., 30 sec |

(Rinsing was effected by three-tank countercurrent system from rinsing tank (3) to rinsing tank (1).)

Processing solutions used in the above-mentioned steps were as follows.

| Color Developer: | |
|---|---|
| Water | 800 ml |
| Ethylenediaminetetraacetic acid | 2.0 g |
| 5,6-Dihydroxybenzene-1,2,4-trisulfonic acid | 0.3 g |
| Triethanolamine | 8.0 g |

-continued

| | |
|---|---|
| Sodium chloride | 1.4 g |
| Potassium carbonate | 25 g |
| N-ethyl-N-(β-methanesulfonamidoethyl)-3-methyl-4-aminoaniline sulfate | 5.0 g |
| Diethylhydroxylamine | 4.2 g |
| Fluororescent brightening agent (4,4'-diaminostilbene compound) | 2.0 g |
| Water to make | 1000 ml |
| pH (25° C.) | 10.05 |
| Bleach-fixing Solution: | |
| Water | 400 ml |
| Ammonium thiosulfate (70% aqueous solution) | 100 ml |
| Sodium sulfite | 17 g |
| Ammonium ferric(III) ethylenediaminetetraacetate | 55 g |
| Disodium ethylenediaminetetraacetate | 5 g |
| Glacial acetic acid | 9 g |
| Water to make | 1000 ml |
| pH (25° C.) | 5.40 |

Rinsing Solution

Ion-exchanged water (having calcium and magnesium contents of 3 ppm or less each).

In the example, development was effected by the use of an automatic developing machine. The characteristic features of the machine used are as follows: (1) All the processing baths have a liquid-circulating mechanism where the tank solution is jetted against the surface of the light-sensitive layer of the photographic material being processed by a jet stream having a speed of about 1 m/sec and the amount of the stream is about 7 l/min./meter (width of the photographic material). The jet stream of the solution vertically colloides with the surface of the photographic material in the processing solution. The jet stream is provided from nozzles arranged in two lines in the processing solution vertically to the transferring direction of the photographic material. Two lines of nozzles are positioned so that the first jet stream collides with the photographic material after 8 seconds from entering of the photographic material into the processing solution. The second line of nozzles is placed at a distance of 1 cm from the first line of nozzles. The nozzle has a diameter of 0.5 mm, and 61 nozzles are positioned apart from each other in a distance of 5 mm in the line. The photographic material is transferred at speed of 1.2 m/min. (3) The ratio of the surface area of the color developer bath which is in contact with air to the total capacity of the developer bath is 0.05 $cm^2$/ml or less. (4) Where the photographic material being processed in the color developing bath or bleaching bath and being processed in the next bath, the ratio of the time for the photographic material passing through air to that in the bath is 0.7 or less. (5) Plural squeezing rollers are provided between the final rinsing bath and the drying means, for the purpose of wiping the liquid as adhered to the surface of the photographic material to be dried. (6) An air-circulating mechanism is provided, which may blow dry air to the surface of the light-sensitive layer of the photographic material being dried, through a porous plate or a slit at an air-blowing speed of 3 m/sec with rapidly removing moisture-containing air of a so-called returned air from the surface of the material.

The reflection density of each of the thus developed samples was measured by the use of a densitometer (TCD Type, manufactured by Fuji Photo Film Co., Ltd.), and characteristic curves for the blue-sensitive layer, green-sensitive layer and red-sensitive layer were obtained. On each of the thus obtained characteristic curves, the inclination of the line formed by linking two points (one having a density of 0.3 and the other having a density of 1.8), which indicates a ratio of (difference of density in the two points)/(difference of logarithmic value of exposure amount in the two points), was called a gamma-one ($\gamma_1$) value ($\gamma_1$) of each sample in each process. Next, the samples were processed in accordance with each of the above-mentioned processes (I) and (II) where the temperature of the color developer bath was elevated by 2° C., and the gamma-two ($\gamma_2$) value of each sample was obtained analogously. The difference between the two gamma values was obtained, which represents a criterion of the stability of tone-reproducibility of the processed photographic material sample. The values of for each sample obtained as mentioned above are shown in Tables 6 and 7 below. For evaluation, the mark "0" means that the difference in the value of ($\gamma_2-\gamma_1$) between the respective layers of the blue-sensitive layer, green-sensitive layer and red-sensitive layer was small and therefore the sample is practically favorable; and the mark "X" means that the sample is practically unfavorable.

The alkali-swelled film pH value of all the photographic material samples shown in Tables 4 and 5 is within the range of from 9.4 to 9.6.

Additionally, the value of ($\gamma_2-\gamma_1$) itself is also preferred to be smaller. Regarding the development process (I) in Table 6, the process has the disadvantage of having a longer development time. As the results in Table 6 were obtained along with such a disadvantage, these were not evaluated to be particularly good although the value of ($\gamma_2-\gamma_1$) was small.

TABLE 6

| Sample No. | $\gamma_2-\gamma_1$ Blue-Sensitive Layer | Green-Sensitive Layer | Red-Sensitive Layer | Evaluation | |
|---|---|---|---|---|---|
| Evaluation of Development Process (I) | | | | | |
| 10 | +0.04 | +0.04 | 0.00 | ○ | Control Color Image-Forming Method |
| 11 | +0.04 | +0.04 | 0.00 | ○ | |
| 12 | +0.04 | +0.04 | 0.00 | ○ | |
| 13 | +0.02 | +0.04 | 0.00 | ○ | |
| 14 | +0.06 | +0.06 | +0.02 | ○ | |
| 15 | +0.06 | +0.04 | +0.00 | ○ | |
| 16 | +0.08 | +0.06 | +0.02 | ○ | |
| Evaluation of Development Process (II) | | | | | |
| 10 | +0.12 | +0.18 | +0.10 | ○ | Color Image-Forming Method of the Invention |
| 11 | +0.12 | +0.18 | +0.12 | ○ | |
| 12 | +0.12 | +0.18 | +0.14 | ○ | |
| 13 | +0.10 | +0.16 | +0.12 | ○ | |
| 14 | +0.32 | +0.26 | +0.22 | ○ | |
| 15 | +0.32 | +0.18 | +0.12 | x | Comparative Color Image-Forming Method |
| 16 | +0.54 | +0.26 | +0.22 | x | |

As is obvious from the results shown in Table 6 above, the stability of the tone-reproducibility (which is not so problematic in development process (I) of a relatively long period of time) is a great problem in development process (II) of an extremely short period of time which is employed in the method of the present invention. It is apparent that the method of the present invention is extremely effective for overcoming this problem. Regarding Sample No. 14, the effect of the present invention could be attained as having a close value of ($\gamma_2-\gamma_1$) in the three light-sensitive layers. However, the value of ($\gamma_2-\gamma_1$) itself is relatively large and therefore Sample No. 14 was somewhat inferior to Samples Nos. 10 to 13 in this respect. Accordingly, in order to more favorably realize the effects of the present invention, the grain size of the silver halide grains to be employed in the photographic materials desirably falls within the range of from 0.3 micron to 0.7 micron.

TABLE 7

| Sample No. | γ2-γ1 Blue-Sensitive Layer | Green-Sensitive Layer | Red-Sensitive Layer | Evaluation | |
|---|---|---|---|---|---|
| Evaluation of Development Process (I) | | | | | |
| 11 | +0.04 | +0.04 | 0.00 | ○ | Control Color Image-Forming Method |
| 20 | +0.04 | +0.06 | 0.02 | ○ | |
| 21 | +0.04 | +0.04 | 0.02 | ○ | |
| 22 | +0.06 | +0.04 | 0.02 | ○ | |
| 23 | +0.10 | +0.08 | +0.06 | ○ | |
| Evaluation of Development Process (II) | | | | | |
| 11 | +0.12 | +0.18 | +0.12 | ○ | Color Image-Forming Method of the Invention |
| 20 | +0.14 | +0.20 | +0.16 | ○ | |
| 21 | +0.14 | +0.18 | +0.16 | ○ | |
| 22 | +0.30 | +0.20 | +0.16 | x | Comparative Color Image-Forming Method |
| 23 | +0.66 | +0.32 | +0.34 | x | |

From the results shown in Table 7 above, the effects of the present invention are apparent. Specifically, it is noted from the results that the samples having a silver chloride content of less than 95 mol % gave noticeable fluctuation of the gamma values in the blue-sensitive layer, green-sensitive layer and red-sensitive layer. Samples with such a property are not suitable for practical use even though the value of $(\gamma_2-\gamma_1)$ does not differ so much between the three light-sensitive layers. Accordingly, in order to realize the effect of the present invention, it is necessary that the halogen composition of the silver halide grains to be used in preparing photographic materials has a silver chloride content of 95 mol % or more.

EXAMPLE 2

Photographic material Samples Nos. 10 to 16 and 20 to 23 were processed by development process (III) or (IV) mentioned below, in place of the process (II) in Example 1 and the processed samples were evaluated in the same manner as in Example 1. As a result, it was confirmed that the image-forming method of the present invention provides stable tone-reproducibility, similar results obtained by the process (II) in Example 1.

| Processing Steps | Process (III) | Process (IV) |
|---|---|---|
| Color Development | 43° C., 15 sec | 38° C., 15 sec |
| Bleach-fixation | 40° C., 15 sec | 40° C., 15 sec |
| Rinsing (1) | 40° C., 10 sec | 40° C., 10 sec |
| Rinsing (2) | 40° C., 10 sec | 40° C., 10 sec |
| Rinsing (3) | 40° C., 10 sec | 40° C., 10 sec |
| Drying | 80° C., 20 sec | 80° C., 20 sec |

(Rinsing was effected by three-tank countercurrent system from rinsing tank (3) to rinsing tank (1).)

Processing solutions used in the above-mentioned steps were as follows.

| Color Developer: | For Process (III) | For Process (IV) |
|---|---|---|
| Water | 800 ml | 800 ml |
| Ethylenediaminetetraacetic acid-5,6-dihydroxybenzene-1,2,4-trisulfonic acid | 0.3 g | 0.3 g |
| Triethanolamine | 8.0 g | 8.0 g |
| Sodium chloride | 2.5 g | 2.5 g |
| Sodium sulfite | 0.3 g | 0.3 g |
| Potassium carbonate | 25.0 g | 25.0 g |
| N-ethyl-N-(β-methanesulfonamidoethyl)-3-methyl-4-aminoaniline sulfate | 5.0 g | 0.0 g |
| 2-Methyl-4-[N-ethyl-N-(β-hydroxyethyl)amino]aniline | 0.5 g | 12.0 g |
| Diethylhydroxylamine | 4.2 g | 4.2 g |
| Fluororescent brightening agent 4,4-diaminostilbene compound) | 2.0 g | 2.0 g |
| Water to make | 1000 ml | 1000 ml |
| pH (25° C.) | 10.10 | 10.10 |

EXAMPLE 3

Photographic material Samples Nos. 31 to 33 were prepared in the same manner as that for preparing Sample No. 11 in Example 1, except that the amount of gelatin in the first to seventh layers was increased or decreased or was substituted by a different water-soluble synthetic polymer. Additionally, photographic material sample No. 34 was also prepared in the same manner, except that the kinds of the emulsions used were varied as indicated in Table 8 below. As the water-soluble synthetic polymer (which will be referred to as "polymer" in the example), polyacrylamide (having mean molecular weight of from 100,000 to 200,000) was employed.

TABLE 8

| Sample No. | 11 | 31 | 32 | 33 | 15 | 34 |
|---|---|---|---|---|---|---|
| First Layer: | | | | | | |
| Gelatin (g) | 1.10 | 0.77 | 1.98 | 2.31 | 1.10 | 0.77 |
| Polymer (g) | — | 0.33 | — | — | — | 0.33 |
| Emulsion | A-1 | A-1 | A-1 | A-1 | A-3 | A-3 |
| Second Layer: | | | | | | |
| Gelatin | 0.59 | 0.41 | 1.06 | 1.24 | 0.59 | 0.41 |
| Polymer | — | 0.18 | — | — | — | 0.18 |
| Third Layer: | | | | | | |
| Gelatin | 1.07 | 0.75 | 1.93 | 2.25 | 1.07 | 0.75 |
| Polymer | — | 0.32 | — | — | — | 0.32 |
| Emulsion | B-2 | B-2 | B-2 | B-2 | B-2 | B-2 |
| Fourth Layer: | | | | | | |
| Gelatin | 0.95 | 0.67 | 1.71 | 2.00 | 0.95 | 0.67 |
| Polymer | — | 0.28 | — | — | — | 0.28 |
| Fifth Layer: | | | | | | |
| Gelatin | 0.80 | 0.56 | 1.44 | 1.68 | 0.80 | 0.56 |
| Polymer | — | 0.24 | — | — | — | 0.24 |
| Emulsion | C-2 | C-2 | C-2 | C-2 | C-2 | C-2 |
| Sixth Layer: | | | | | | |
| Gelatin | 0.32 | 0.22 | 0.58 | 0.67 | 0.32 | 0.22 |
| Polymer | — | 0.10 | — | — | — | 0.10 |
| Seventh Layer: | | | | | | |
| Gelatin | 1.06 | 0.74 | 1.91 | 2.23 | 1.06 | 0.74 |
| Polymer | — | 0.32 | — | — | — | 0.32 |

The alkali-swelled film pH value of each of the thus prepared photographic material sample Nos. 11, 15 and 31 to 34 was measured and the results shown in Table 9 were obtained. Additionally, these samples were processed by Process (IV) of Example 2 and evaluated in the same manner in Example 1. The results obtained are shown in Table 10 below.

TABLE 9

| Sample No. | Mean Grain Size of Silver Halide Grains and Alkali-Swelled Film pH Value: Blue-Sensitive Layer | Green-Sensitive Layer | Red-Sensitive Layer | Alkali-Swelled Film pH Value | Maximum Ratio of Grain Size | |
|---|---|---|---|---|---|---|
| 11 | 0.50 μm Emulsion (A-1) | 0.49 μm Emulsion (B-2) | 0.51 μm Emulsion (C-2) | 9.2 | 1.04 | Example of the Invention |
| 31 | 0.50 μm Emulsion (A-1) | 0.49 μm Emulsion (B-2) | 0.51 μm Emulsion (C-2) | 9.6 | 1.04 | Example of the Invention |
| 32 | 0.50 μm Emulsion (A-1) | 0.49 μm Emulsion (B-2) | 0.51 μm Emulsion (C-2) | 8.8 | 1.04 | Comparative Example |
| 33 | 0.50 μm Emulsion (A-1) | 0.49 μm Emulsion (B-2) | 0.51 μm Emulsion (C-2) | 8.4 | 1.04 | Comparative Example |
| 15 | 0.72 μm Emulsion (A-3) | 0.49 μm Emulsion (B-2) | 0.51 μm Emulsion (C-2) | 9.2 | 1.47 | Comparative Example |
| 34 | 0.72 μm Emulsion (A-3) | 0.49 μm Emulsion (B-2) | 0.51 μm Emulsion (C-2) | 9.6 | 1.47 | Comparative Example |

TABLE 10

| Sample No. | Results of Evaluation: Value of ($\gamma_2$-$\gamma_1$): Blue-Sensitive Layer | Green-Sensitive Layer | Red-Sensitive Layer | Evaluation |
|---|---|---|---|---|
| 11 (Example of the Invention) | +0.09 | +0.12 | +0.09 | ○ |
| 31 (Example of the Invention) | +0.06 | +0.07 | +0.06 | ○ |
| 32 (Comparative Example) | +0.34 | +0.40 | +0.32 | x |
| 33 (Comparative Example) | +0.46 | +0.62 | +0.42 | x |
| 15 (Comparative Example) | +0.28 | +0.14 | +0.10 | x |
| 34 (Comparative Example) | +0.24 | +0.08 | +0.07 | x |

As is apparent from the results shown in Table 10 above, the image-forming method of the present invention using Samples Nos. 11 and 31 gave a small fluctuation of tone reproduction ($\gamma_2-\gamma_1$) in the three light-sensitive layers and therefore favorably gave a well-balanced image constantly. As opposed to this, in the comparative examples, the fluctuation was large or the image formed was not balanced. Therefore, the method of the comparative example is obviously unfavorable. Accordingly, it is noted that in order to realize the effects of the present invention, the ratio of the mean grain size of the silver halide grains in the three light-sensitive layers is to be from 0.77 to 1.3 and the alkali-swelled film pH value is to be 9 or more.

EXAMPLE 4

Silver Halide Emulsion (A-8) was prepared in the same manner as Silver Halide Emulsion (A-1) in Example 1, except that the following Color-Sensitizing Dye (V-5) and Color-Sensitizing Dye (V-6) were employed in an amount of $1.3\times10^{-4}$ mol and $1.0\times10^{-4}$ mol per mole of silver halide, respectively, in place of Color-Sensitizing Dye (V-1).

(V-5)

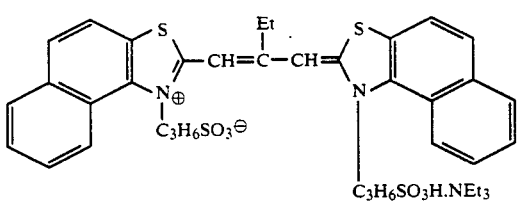

(V-6)

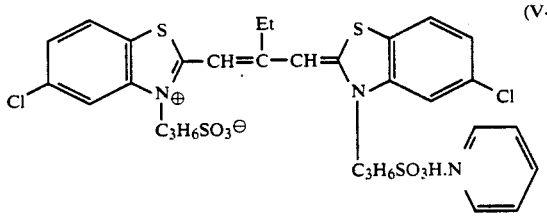

Next, Silver Halide Emulsion (B-7) was prepared in the same manner as Silver Halide Emulsion (B-1) in Example 1, except that the following Color-Sensitizing Dye (V-7) was employed in an amount of $4.5\times10^{-5}$ mol per mole of silver halide in place of Color-Sensitizing Dyes (V-2) and (V-3).

(V-7)

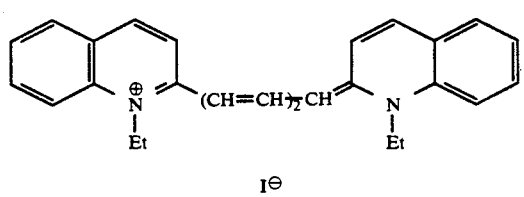

Next, Silver Halide Emulsion (C-7) was prepared in the same manner as Silver Halide Emulsion (C-1) in Example 1, except that the following Spectrally-Sensitizing Dye (V-8) was employed in an amount of $5\times10^{-6}$ mol per mol of silver halide in place of Color-Sensitizing Dye (V-4).

(V-8)

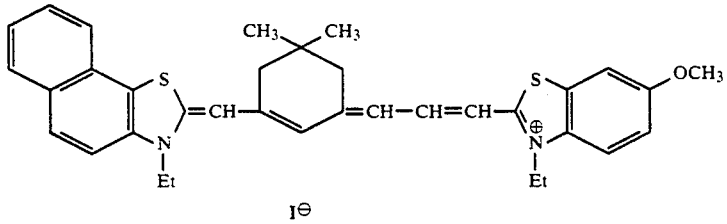

Next, photographic material Sample No. 30 was prepared in the same manner as Sample No. 11 in Example 1, except that the same amount of Emulsion (A-8) was used in place of Emulsion (A-1) in the first layer, the same amount of Emulsion (B-7) was in place of Emulsion (B-2) in the third layer, and the same amount of Emulsion (C-7) was in place of Emulsion (C-2) in the fifth layer, and the following compound was added to the third layer in an amount of $2.6\times10^{-3}$ mol per mole of silver halide.

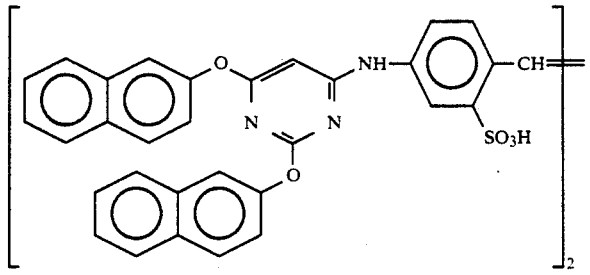

Photographic material sample No. 30 thus prepared was an infrared-sensitive color photographic material. The functions of all the light-sensitive layers in Sample No. 30 are shown in Table 11 below, as compared with the corresponding layers in Sample No. 11.

TABLE 11

| | Sample No. 11 | Sample No. 30 |
|---|---|---|
| First Layer | Blue-sensitive yellow-coloring layer | Red-sensitive yellow-coloring layer |
| Third Layer | Green-sensitive magenta coloring layer | Infrared-sensitive magenta-coloring layer |
| Fifth Layer | Red-sensitive cyan-coloring layer | Infrared-sensitive cyan-coloring layer |

The other layers were sample in Sample No. 11 and Sample No. 30.

Evaluation of Photographic Material Sample

The thus prepared photographic material sample No. 30 was wedgewise exposed through color-separating filters of three kinds mentioned in Table 12 below, by the use of a sensitometer (FWH Type, manufactured by Fuji Photo Film Co., Ltd.; color temperature of light source 3200° K.). The filters used were interference filters.

TABLE 12

| | Peak Wavelength of Transmitted Light (nm) | Half-Value Width (nm) |
|---|---|---|
| (1) Color-separating filter for exposure of yellow-coloring layer | 670 | 20 |
| (2) Color-separating filter for exposure of magenta-coloring layer | 750 | 20 |
| (3) Color-separating filter for exposure of cyan-coloring layer | 810 | 20 |

The exposure amount through the above-mentioned color-separating filters was 500 erg/cm$^2$. The exposure time was 0.1 second.

The thus exposed Sample No. 30 was then processed by Process (IV) of Example 2 and the properties of the processed sample were evaluated. As a result, a well-balanced and stable color image was obtained like Sample No. 11 in Table 10 above, where the processed three light-sensitive layers were well balanced.

EXAMPLE 5

For evaluating the photographic material sample of Example 4, the sample was imagewise exposed by the use of a semiconductor laser (hereinafter referred to as "LD") as shown in Table 13 below, in place of being exposed with a sensitometer. Precisely, in the imagewise exposure of the case, the three rays as obtained from the three kinds of LD mentioned below were synthesized into one ray and was applied to the photographic material sample by scanning exposure with a rotating polyhedron, whereupon the respective laser rays were so adjusted that the diameter of the luminous point on the photographic material sample could be about 0.03 mm by controlling the aperture. The intensity and the irradiating time were electrically controlled in accordance with the necessary image density. The photographic material sample was imagewise exposed by transferring it in the direction vertical to the scanning direction at a constant speed, and the time necessary for exposure was about 10 seconds for forming an image having a size of 420 mm length and 297 mm width.

The thus exposed Sample No. 30 was then processed by Process (IV) of Example 2 to form a color image. Additionally, images were continuously and repeatedly formed by this process; and images were repeatedly formed with intervals of several days. The conditions of the finished images in all the cases were checked. As a result, all the images formed were stable. In the present example, the wavelength for exposure and the hue in the color image formed are set forth in Table 13 below. However, these particular combinations are not indispensable in obtaining the effects of the present invention.

TABLE 13

| | Kind of LD | Oscillating Wavelength (nm) |
|---|---|---|
| (1) LD for exposing yellow-coloring layer | AlGaInP | ca. 670 |
| (2) LD for exposing magenta-coloring layer | GaAlAs | ca. 750 |
| (3) LD for exposing cyan-coloring layer | GaAlAs | ca. 810 |

As mentioned above, favorable color images can stably be obtained by the method of the present invention by development in an extremely short period of time. Particularly, stable tone-reproducibility can be attained by the method of the present invention.

Samples Nos. 1 to 16 were evaluated in the same manner as in Example 1 except Development Process (V) was used instead of Development Process (II). Development Process (V) is the same as Development Process (II) except that the apparatus was designed so that jet stream stirring in the color developing bath is not carried out and the treating solution which is returned to the bath through a circulation pump does not directly contact the surface of the photographic material. Results similar to those shown in Table 6 were obtained, however, the color density in the photographic material thus treated was uneven, and since the color density per se is low accurate values of $\gamma_1$ and $\gamma_2$ could not be calculated.

Unevenness of the color density was evaluated as follows.

A sheet of Sample 10 having A4 size was prepared. Using an enlarger for a color paper the sheet was exposed through a filter which was controlled so that the mean color density of each of cyan, magenta and yellow of whole sheet, obtained by using Development Process (II) or (V) to be 1.0±0.1.

After subjecting the thus exposed photographic material to Development Process (II) or (V), density of the sheet at 20 positions selected at random was measured. The results are shown in Table 14 wherein unevenness of the density can be seen. The relative exposure values which were used in order to obtain the same mean density using Development Processes (II) and (V) are also shown in Table 14.

TABLE 14

| Development Process | Degree of Unevenness of Density (The lowest density and the highest density of G-filter) | Relative Exposure Value |
|---|---|---|
| (II) | 0.97–1.03 | 100 |

TABLE 14-continued

| Development Process | Degree of Unevenness of Density (The lowest density and the highest density of G-filter) | Relative Exposure Value |
|---|---|---|
| (V) | 0.89–1.09 | 118 |

From these results it can be understood that in the case of Development Process (V) whereto the jet stream stirring was not applied, unevenness of the image density is large and the color density (sensitivity) is low.

Since the evenness of color density obtained by Development Process (I) of Example 1 (wherein the color development time is long) is good even though the jet stream stirring was not used, it can be considered that such a phenomenon obtained above is characteristic for an extremely short time treatment. Therefore, the technique of the present invention can provide practically useful and evident effects when a jet stream stirring is used in the color development.

While the invention has been described in detail and with reference to specific embodiments thereof, it will be apparent to one skilled in the art that various changes and modifications can be made therein without departing from the spirit and scope thereof.

What is claimed is:

1. A method of forming a color image comprising subjecting an imagewise exposed color photographic material to color development at a temperature of from30° C. to 50° C. and for a period of from 5 seconds to 20 seconds by immersing the photographic material into a color developing solution wherein the solution is applied to the surface of the photosensitive layer of the photographic material as a jet stream while the material is immersed in the color developing solution; wherein said color photographic material comprises a support having thereon at least two silver halide photographic emulsion layers, each of said layers comprising an emulsified dispersion of fine oleophilic grains containing at least one non-diffusive oil-soluble coupler capable of forming a dye by coupling with the oxidation product of an aromatic primary amine color developing agent and at least one high boiling point organic solvent, wherein silver halide grains in all of the silver halide photographic emulsion layers on the support comprise at least 95 mol % silver chloride, and the ratio of the silver halide mean grain size calculated for each photographic emulsion layer on the support to that calculated for any other photographic emulsion layer is from 0.77/1 to 1.3/1, and wherein the color photographic material has an alkali-swelled film pH value of at least 9.0.

2. The method of forming a color image as in claim 1, wherein the color development takes places at a temperature of from 35° C. to 50° C. and for a period of from 5 seconds to 15 seconds.

3. The method of forming a color image as in claim 1, wherein the color photographic material has an alkali-swelled film pH value of 9.0 to 12.0.

4. The method of forming a color image as in claim 1, wherein the color photographic material has an alkali-swelled film pH value of 9.40 to 11.4.

5. The method of forming a color image as in claim 1, wherein the speed of the jet stream of the developing solution applied to the photographic material is from 0.3 to 3 m/sec.

6. The method of forming a color image as in claim 1, wherein the speed of the jet stream of the developing solution applied to the photographic material is from 0.5 to 2 m/sec.

7. The method of forming a color image as in claim 1, wherein the amount of the developing solution contacting the photosensitive layer by said jet stream is at least 0.6 l/min/$m^2$.

8. The method of forming a color image as in claim 1, wherein the photographic material is transferred in the developing solution at a speed of 0.1 to 10 m/min and the amount of the developing solution contacting the photosensitive layer by said jet stream is at least 0.6 l/min/meter (width of the photographic material).

9. The method of forming a color image as in claim 1, wherein the silver chloride content of the monodispersed silver halide grains is at least 98 mol %.

10. The method of forming a color image as in claim 1, wherein the ratio of the mean grain size calculated for each photographic emulsion layer to that calculated for any other photographic emulsion layer is from 0.83/1 to 1.2/1.

11. The method of forming a color image as in claim 1, wherein said coupler is at least one of cyan coupler selected from the group consisting of compounds represented by general formulae (C-I) or (C-II):

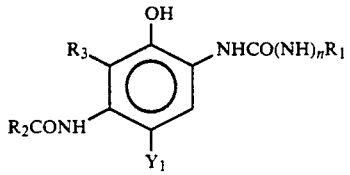

(C-I)

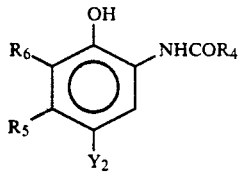

(C-II)

wherein $R_1$, $R_2$ and $R_4$ independently represent a substituted or unsubstituted aliphatic, aromatic or heterocyclic group; $R_3$, $R_5$ and $R_6$ independently represent a hydrogen atom, a halogen atom, an aliphatic group, an aromatic group or an acylamino group; $R_3$ may form, along with $R_2$, a non-metallic atomic group for forming a nitrogen-containing 5-membered or 6-membered ring; $Y_1$ and $Y_2$ independently represent a hydrogen atom or a group capable of being released upon a coupling reaction with the oxidation product of a developing agent; and n represents 0 or 1.

12. The method of forming a color image as in claim 1, wherein said coupler is a magenta coupler selected from the group consisting of compounds represented by general formulae (M-I) or (M-II):

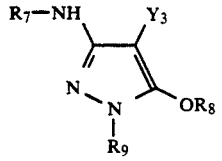

(M-I)

-continued

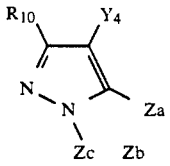

(M-II)

wherein $R_7$ and $R_9$ independently represent an aryl group; $R_8$ represents a hydrogen atom, an aliphatic or aromatic acyl group, or an aliphatic or aromatic sulfonyl group; $Y_3$ represents a hydrogen atom or a releasing group; $R_{10}$ represents a hydrogen atom or a substituent; $Y_4$ represents a hydrogen atom or a releasing group; Za, Zb and Zc independently represent a methine group, a substituted methine group, =N— or —NH—, and one of the Za-Zb bond and the Zb-Zc bond is a double bond while the other is a single bond; when the Zb-Zc bond is a carbon-carbon double bond, it may be a part of an aromatic ring; and the coupler of formula (M-I) or (M-II) may form a dimer or polymer at $R_7$, $R_{10}$ or $Y_4$ or at Za, Zb or Zc when this group is a substituted methine group.

13. The method of forming a color image as in claim 1, wherein said coupler is a yellow coupler selected from the group consisting of compounds represented by general formula (Y):

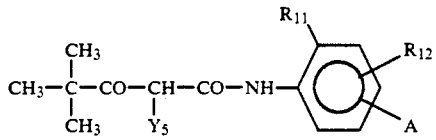

(Y)

wherein $R_{11}$ represents a halogen atom, an alkoxy group, a trifluoromethyl group or an aryl group;

$R_{12}$ represents a hydrogen atom, a halogen atom or an alkoxy group;

A represents $—NHCOR_{13}$, $—NHSO_2—R_{13}$, $—SO_2NHR_{13}$, $—COOR_{13}$ or $—SO_2NR_{13}R_{14}$;

$R_{13}$ and $R_{14}$ independently represent an alkyl group, an aryl group or an acyl group; and $Y_5$ represents a releasing group.

14. The method of forming a color image as in claim 1, wherein the high boiling point organic solvent is a compound of formulae (A) to (E):

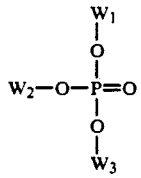

(A)

$W_1—COO—W_2$ (B)

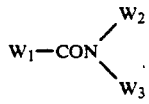

(C)

-continued (D)

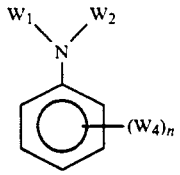

(E)

$W_1-O-W_2$ wherein $W_1$, $W_2$ and $W_3$ independently represent a substituted or unsubstituted alkyl, cycloalkyl, alkenyl, aryl or heterocyclic group;

$W_4$ represents $W_1$, $OW_1$ or $SW_1$;

n represents an integer of from 1 to 5; and when n is 2 or more, plural $W_4$'s may be same or different; and $W_1$ and $W_2$ may form a condensed ring.

15. The method of forming a color image as in claim 1, wherein said at least two silver halide photographic emulsion layers are at least one red-sensitive layer, at least one green-sensitive layer and at least one blue-sensitive layer.

* * * * *